US008284222B2

(12) United States Patent
Ishimi et al.

(10) Patent No.: US 8,284,222 B2
(45) Date of Patent: Oct. 9, 2012

(54) IMAGE ERASING METHOD AND IMAGE ERASING APPARATUS

(75) Inventors: Tomomi Ishimi, Shizuoka (JP); Shinya Kawahara, Shizuoka (JP); Toshiaki Asai, Shizuoka (JP); Yoshihiko Hotta, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 180 days.

(21) Appl. No.: 12/904,566

(22) Filed: Oct. 14, 2010

(65) Prior Publication Data

US 2011/0090296 A1 Apr. 21, 2011

(30) Foreign Application Priority Data

Oct. 19, 2009 (JP) ..... 2009-240679

(51) Int. Cl.
*B41J 29/16* (2006.01)

(52) U.S. Cl. ..... 347/179

(58) Field of Classification Search ..... 347/179, 347/171–174, 104, 105, 131, 223, 224, 229, 347/233, 234, 239, 248; 399/4, 186–188; 250/316.1, 317.1

See application file for complete search history.

(56) References Cited

U.S. PATENT DOCUMENTS

| | | | | |
|---|---|---|---|---|
| 4,622,564 | A * | 11/1986 | Kaku et al. | 347/239 |
| 7,422,996 | B2 | 9/2008 | Shimbo et al. | |
| 7,439,993 | B2 | 10/2008 | Ishimi et al. | |
| 7,728,860 | B2 * | 6/2010 | Kawahara et al. | 347/224 |
| 2004/0183883 | A1 | 9/2004 | Suzuki et al. | |
| 2007/0225162 | A1 | 9/2007 | Kawahara et al. | |
| 2007/0285488 | A1 * | 12/2007 | Ishimi et al. | 347/179 |
| 2008/0151033 | A1 | 6/2008 | Ishimi et al. | |
| 2008/0153698 | A1 | 6/2008 | Kawahara et al. | |
| 2008/0192618 | A1 | 8/2008 | Nakata et al. | |
| 2008/0214391 | A1 | 9/2008 | Kawahara et al. | |

(Continued)

FOREIGN PATENT DOCUMENTS

EP 1834795 A1 9/2007

(Continued)

OTHER PUBLICATIONS

Jan. 13, 2011 European search report in connection with counterpart European patent application No. 10 18 7925.

*Primary Examiner* — Kristal Feggins
(74) *Attorney, Agent, or Firm* — Cooper & Dunham LLP

(57) ABSTRACT

An image erasing apparatus including: a semiconductor laser array in which a plurality of semiconductor laser light sources are linearly aligned; a width direction collimating unit provided on an output surface of the semiconductor laser array, and configured to collimate, in a width direction, broadening of laser beams emitted from the semiconductor laser array so as to form a linear beam; and a length direction light distribution controlling unit configured to control a length of a major axis of the linear beam to be longer than a length of a major axis of an emission part of the semiconductor laser array, and to attain uniform light distribution in the length direction of the linear beam; wherein the linear beam, which has the major axis whose length is longer than the length of the major axis of the emission part of the semiconductor laser array and uniform light distribution in the length direction thereof, is to be applied to and heat a thermoreversible recording medium, in which any of transparency and color tone thereof reversibly changes depending on temperature, so as to erase an image recorded on the thermoreversible recording medium.

15 Claims, 8 Drawing Sheets

U.S. PATENT DOCUMENTS

| | | | |
|---|---|---|---|
| 2009/0075816 | A1 | 3/2009 | Kawahara et al. |
| 2009/0203521 | A1 | 8/2009 | Ishimi et al. |
| 2010/0039916 | A1 | 2/2010 | Hasegawa et al. |
| 2010/0054106 | A1 | 3/2010 | Asai et al. |
| 2010/0061198 | A1 | 3/2010 | Kawahara et al. |
| 2010/0069238 | A1 | 3/2010 | Asai et al. |
| 2010/0069239 | A1 | 3/2010 | Asai et al. |
| 2010/0197492 | A1 | 8/2010 | Kawahara et al. |

FOREIGN PATENT DOCUMENTS

| | | |
|---|---|---|
| JP | 4263228 | 20/2009 |
| JP | 6-274932 | 9/1994 |
| JP | 9-30118 | 2/1997 |
| JP | 10-92729 | 4/1998 |
| JP | 11-151856 | 6/1999 |
| JP | 2000-136022 | 5/2000 |
| JP | 3161199 | 2/2001 |
| JP | 3256090 | 11/2001 |
| JP | 2002-353090 | 12/2002 |
| JP | 2004-265247 | 9/2004 |
| JP | 3605047 | 10/2004 |
| JP | 2007-76768 | 3/2007 |
| JP | 3998193 | 8/2007 |
| JP | 2008-62506 | 3/2008 |
| JP | 2008-137243 | 6/2008 |
| JP | 2008-213439 | 9/2008 |

* cited by examiner

IMAGE ERASING METHOD AND IMAGE ERASING APPARATUS

BACKGROUND OF THE INVENTION

1. Field of the Invention

The present invention relates to and image erasing method and an image erasing apparatus capable of erasing an image, which has been recorded on a thermoreversible recording medium, by converting beams emitted from a semiconductor laser (LD) array in which a plurality of semiconductor lasers (LD) are linearly aligned to a linear beam having a high uniformity through an optical lens, and applying the linear beam to the thermoreversible recording medium.

2. Description of the Related Art

Each image has been so far recorded and erased on a thermoreversible recording medium (hereinafter, may be referred to as "recording medium" or "medium") by a contact method in which the thermoreversible recording medium is heated by making contact with a heat source. For the heat source, in the case of image recording, a thermal head is generally used, and in the case of image erasing, a heat roller, a ceramic heater or the like is generally used.

Such a contact image processing method has advantages in that when a thermoreversible recording medium is composed of a flexible material such as film and paper, an image can be uniformly recorded and erased by evenly pressing a heat source against the thermoreversible recording medium with use of a platen, and an image recording apparatus and an image erasing apparatus can be produced at cheap cost by using components of a conventional thermosensitive printer. However, when a thermoreversible recording medium incorporates an RF-ID tag as described in Japanese Patent Application Laid-Open (JP-A) No. 2004-265247 and Japanese Patent (JP-B) No. 3998193, the thickness of the thermoreversible recording medium is thickened and the flexibility thereof is degraded. Therefore, to uniformly press a heat source against the thermoreversible recording medium, it needs a high-pressure. Moreover, in the contact type, a surface of the recording medium is scraped due to repetitive recording and erasure and irregularity is formed thereon, and some parts are not in contact with a heating source such as a thermal head or hot stamping. Thus, the recording medium may not be uniformly heated, causing decrease of image density or erasure failure (Japanese Patent (JP-B) No. 3161199 and Japanese Patent Application Laid-Open (JP-A) No. 09-30118).

In view of the fact that RF-ID tag enables reading and rewriting of memory information from some distance away from a thermoreversible recording medium in a non-contact manner, a demand arises for thermoreversible recording media as well. The demand is that an image be rewritten on such a thermoreversible recording medium from some distance away from the thermoreversible recording medium. To respond to the demand, a method using a laser is proposed as a method of recording and erasing each image on a thermoreversible recording medium from some distance away from the thermoreversible recording medium when there are irregularities on the surface thereof (see JP-A No. 2000-136022). It is the method by which non-contact recording is performed by using thermoreversible recording media on shipping containers used for physical distribution lines. Writing is performed by using a laser and erasing is performed by using a hot air, heated water, infrared heater, etc.

As such a recording method using a laser, a recording device (laser maker) is proposed of which a thermoreversible recording medium is irradiated with a high output laser beam, and the irradiated position can be controlled. A thermoreversible recording medium is irradiated with a laser beam using the laser marker, and a photothermal conversion material in the recording medium absorbs light so as to convert it into heat, which can record and erase the image. An image recording and erasing method using a laser has been proposed, wherein a recording medium including a leuco dye, a reversible developer and various photothermal conversion materials in combination is used, and recording is performed thereon using a near infrared laser beam (see, JP-A No. 11-151856).

As a method for recording on a rewritable thermoreversible recording medium using a near-infrared laser beam, for example, there is a method in which non-contact rewriting is performed using laser beams emitted from a semiconductor laser (LD) light source.

In a laser recording apparatus (laser marker) performing non-contact rewriting using a semiconductor laser, a small circular beam of high output is necessary to print small words with a thin line at high speed. Thus, as shown in FIG. 1, in order to convert linear beams emitted from a LD array 1 including a plurality of LD light sources to a circular beam, a fiber coupled LD constituted with a special optical lens system 11, a optical fiber 12, and the like is used. However, the larger the number of the LD array light sources becomes for higher output of the laser beam, the more complicated the special optical lens system 11 is. Thus, a cost for an apparatus increases. Moreover, in the fiber coupled LD, the lens system is mounted so that the LD light sources cannot be cooled directly. Therefore, the fiber coupled LD has poor cooling efficiency, and difficulty in increasing output. In addition, the fiber coupled LD is a complicated optical system, and thus all laser beams cannot enter the fiber, causing decrease in efficiency, and difficulty in increasing output.

In the case of image recording, a portion where an image is recorded is irradiated with a laser beam by a vector method, while in the case of image erasing, a thermoreversible recording medium is entirely irradiated with a laser beam. In order to perform image erasing at high speed, it is necessary to increase the out put of the laser beam.

As an image erasing method using the laser recording apparatus, as shown in FIGS. 2A to 2D, proposed is an image erasing method in which scanning is performed by superimposing in parallel circular beams emitted from a typical laser marker (see Japanese Patent (JP-B) No. 4263228, Japanese Patent Application (JP-A) Nos. 2008-62506 and 2008-213439).

However, these proposed methods have such a problem that a cost for an apparatus is high for increasing the output of a laser beam.

In order to increase the output of a LD light source, a LD element (LD array) including a plurality of LD light sources is generally used, since the LD light source may be broken when the output of the LD light source formed of a single light source is drastically increased. For example, a laser beam heating tool is proposed in JP-B No. 3256090. In the proposed laser beam heating tool, laser beams emitted from a LD array 1 in which a plurality of light sources are linearly aligned, is converted to a strip-shaped beam using a first cylindrical lens 13 as shown in FIG. 3. In FIG. 3, 14 denotes a second cylindrical lens for focusing a parallel strip-shaped beams emitted from a first cylindrical lens 13 in a width direction. However, this proposal does not clearly specify whether or not the strip-shaped beam emitted from the first cylindrical lens 13 is uniform, and beams are focused through the second cylindrical lens 14 so as to perform soldering and correction of soldering. This proposal has different structure and object from those of the present invention.

An image recording and erasing are proposed in JP-A No. 2008-137243. Here, an image recording and erasing is performed on a thermoreversible recording medium using a line light source in which an imaging lens is provided to each light source of a LD array, and the LD array includes a plurality of light sources which are aligned so as to form a strip-shaped beam having uniform light distribution.

However, in this proposal, since the imaging lens is provided with respect to each of the light sources of the LD array, the apparatus has a complicated structure. The width of the light source of the LD array and the width of the irradiated beam on a thermoreversible recording medium are the same. It is necessary to broaden the width of the LD array light source. As a result, there are such problems that the apparatus size becomes large, and a cost for the apparatus outstandingly increases.

Moreover, JP-A Nos. 10-92729 and 2002-353090 discloses a lighting unit in which an optical lens is mounted so as to form a uniform light distribution. However, JP-A Nos. 10-92729 and 2002-353090 do not disclose nor suggest that image recording and erasing are repeatedly performed on a rewritable thermoreversible recording medium by irradiating it with a near-infrared laser beam.

Therefore, currently, there is a demand for promptly providing an image erasing apparatus and an image erasing method capable of performing erasure at high speed with low energy, and outstandingly decreasing a cost for an apparatus.

BRIEF SUMMARY OF THE INVENTION

An object of the present invention is to provide an image erasing apparatus and image erasing method, in which laser beam scanning is required only in a uniaxial direction owing to use of a linear beam, and the laser beam scanning can be easily performed compared to laser beam scanning using a circular beam, thereby erasing at high speed with low energy and significantly reducing a cost for an apparatus.

The inventors of the present invention have been intensively studied in order to solve the above problems, and found that a circular beam does not have to be used for image erasure, that a plurality of laser beams are formed into a linear beam through an optical lens using a LD array in which a plurality of LD light sources are linearly aligned, so that a laser beam scanning is performed only in a uniaxial direction and is performed more easily than that using the circular beam, thereby erasing at high speed with low energy and significantly reducing a cost for an apparatus.

The present invention is based on the findings of the inventors of the present invention, and a means for solving the problems are as follows.

<1> An image erasing apparatus including a semiconductor laser array in which a plurality of semiconductor laser light sources are linearly aligned; a width direction collimating unit provided on an output surface of the semiconductor laser array, and configured to collimate, in a width direction, broadening of laser beams emitted from the semiconductor laser array so as to form a linear beam; and a length direction light distribution controlling unit configured to control a length of a major axis of the linear beam to be longer than a length of a major axis of an emission part of the semiconductor laser array, and to attain uniform light distribution in the length direction of the linear beam, wherein the linear beam, which has the major axis whose length is longer than the length of the major axis of the emission part of the semiconductor laser array and uniform light distribution in the length direction thereof, is to be applied to and heat a thermoreversible recording medium, in which any of transparency and color tone thereof reversibly changes depending on temperature, so as to erase an image recorded on the thermoreversible recording medium.

<2> The image erasing apparatus according to <1>, further including a beam size adjusting unit configured to adjust at least one of the length of the major axis of the linear beam and a length of a minor axis of the linear beam, wherein the linear beam has the major axis whose length is longer than the length of the major axis of the emission part of the semiconductor laser array and uniform light distribution in the length direction of the linear beam.

<3> The image erasing apparatus according to any of <1> and <2>, wherein the width direction collimating unit is a cylindrical lens.

<4> The image erasing apparatus according to any of <1> to <3>, wherein the length direction light distribution controlling unit is a lens array.

<5> The image erasing apparatus according to any of <1> to <4>, wherein the length direction light distribution controlling unit is a Fresnel lens.

<6> The image erasing apparatus according to any of <1> to <5>, further including a scanning unit configured to scan the thermoreversible recording medium in a uniaxial direction with the linear beam having the major axis whose length is longer than the length of the major axis of the emission part of the semiconductor laser array and uniform light distribution in the length direction of the linear beam.

<7> The image erasing apparatus according to <6>, wherein the scanning unit is a uniaxial galvano mirror.

<8> The image erasing apparatus according to <6>, wherein the scanning unit is a stepper motor mirror.

<9> The image erasing apparatus according to <6>, wherein the scanning unit is a polygon mirror.

<10> The image erasing apparatus according to any of <1> to <6>, further comprising a moving unit configured to move the thermoreversible recording medium with respect to the linear beam having the major axis whose length is longer than the length of the major axis of the emission part of the semiconductor laser array and uniform light distribution in the length direction of the linear beam so that the thermoreversible recording medium is scanned with the linear beam to erase an image recorded on the thermoreversible recording medium.

<11> The image erasing apparatus according to <10>, wherein the thermoreversible recording medium is attached onto a surface of a container, and the moving unit is configured to move the container.

<12> An image erasing method including: collimating in a width direction broadening of laser beams emitted from a semiconductor laser array, in which a plurality of semiconductor laser light sources are linearly aligned, so as to form a linear beam; and controlling the linear beam to have a major axis whose length is longer than a length of a major axis of an emission part of the semiconductor laser array, and uniform light distribution in a length direction of the linear beam, wherein the linear beam, which has the major axis whose length is longer than the length of the major axis of the emission part of the semiconductor laser array and uniform light distribution in the length direction thereof, is to be applied to and heat a thermoreversible recording medium, in which any of transparency and color tone thereof reversibly changes depending on temperature, so as to erase an image recorded on the thermoreversible recording medium.

<13> The image erasing method according to <12>, further including adjusting at least one of the length of the major axis of the linear beam and a length of a minor axis of the linear beam, wherein the linear beam has the major axis whose length is longer than the length of the major axis of the emission part of the semiconductor laser array and uniform light distribution in the length direction of the linear beam.

<14> The image erasing method according to any of <12> and <13>, further including scanning the thermoreversible recording medium in a uniaxial direction with the linear beam having the major axis whose length is longer than the length of the major axis of the emission part of the semiconductor laser array and uniform light distribution in the length direction of the linear beam.

<15> The image erasing method according to any of <12> and <13>, wherein the erasure of the image recorded on the thermoreversible recording medium is performed by moving the thermoreversible recording medium by means of a moving unit so as to scan the thermoreversible recording medium with the linear beam having the major axis whose length is longer than the length of the major axis of the emission part of the semiconductor laser array and uniform light distribution in the length direction of the linear beam.

The present invention can solve the conventional problems, and provide an image erasing apparatus and an image erasing method, in which laser beam scanning is required only in a uniaxial direction owing to use of a linear beam, and the laser beam scanning can be easily performed compared to laser beam scanning using a circular beam, thereby erasing at high speed with low energy and significantly reducing a cost for an apparatus.

DETAILED DESCRIPTION OF THE INVENTION

Figure 1:
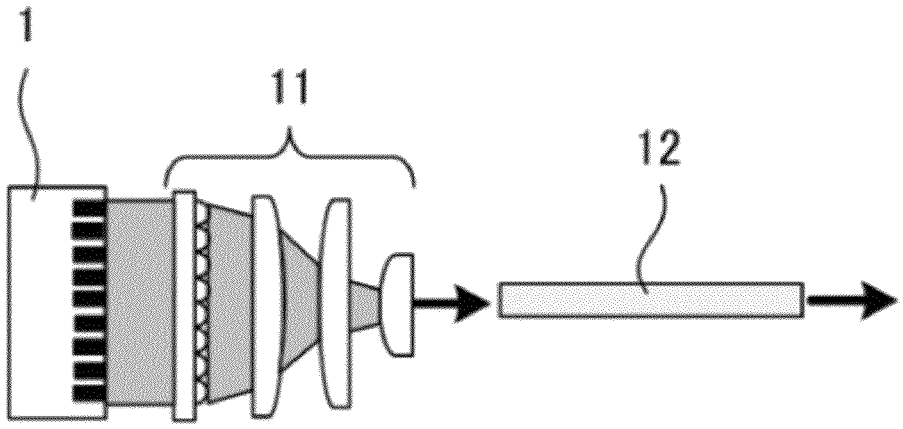
FIG. 1 is a view showing an example of a conventional image erasing apparatus.
Figure 2A:
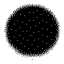
FIG. 2A is a view showing a shape of a conventional laser beam.
Figure 2B:
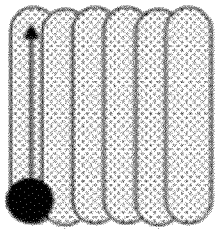
FIGS. 2B to 2D are views showing laser beam scanning methods using the conventional laser beam.
Figure 2C:
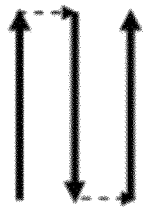
Figure 2D:
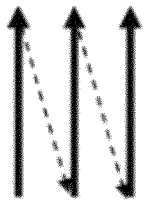
Figure 3:
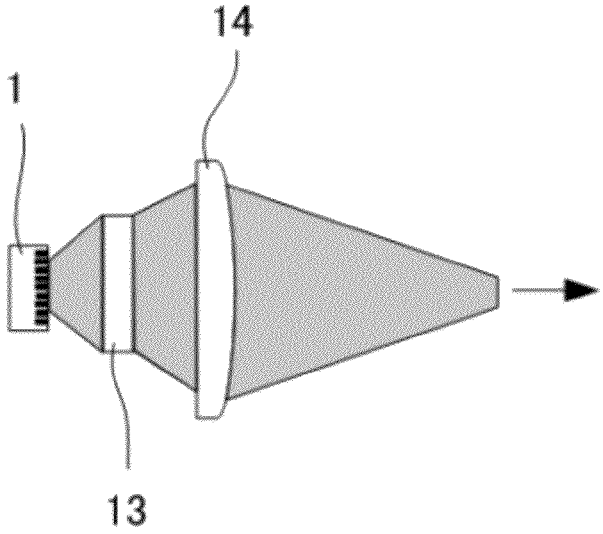
FIG. 3 is a view showing an example of a conventional heating tool using a laser beam.

Image Erasing Apparatus and Image Erasing Method

An image erasing apparatus of the present invention includes at least a semiconductor laser array, a width direction collimating unit, and a length direction light distribution controlling unit, and further includes a beam size adjusting unit, a scanning unit, and other units as necessary.

In the image erasing apparatus of the present invention, a thermoreversible recording medium in which any of transparency and color tone thereof reversibly changes depending on temperature is irradiated with a linear beam, which has a major axis whose length is longer than the length of a major axis of an emission part of the semiconductor laser array and uniform light distribution in the length direction thereof, is to be applied to and heat the thermoreversible recording medium, and then an image recorded thereon is erased.

An image erasing method of the present invention includes at least a width direction collimating step, and a length direction light distribution controlling step, and further includes a beam size adjusting step, a scanning step, and other steps as necessary.

In the image erasing method of the present invention, a thermoreversible recording medium in which any of transparency or color tone reversibly changes depending on temperature is irradiated with a linear beam, which has the major axis whose length is longer than the length of the major axis of the emission part of the semiconductor laser array and uniform light distribution in the length direction thereof, is to be applied to and heat the thermoreversible recording medium, and then an image recorded thereon is erased.

The image erasing method of the present invention can be preferably performed by the image erasing apparatus of the present invention, the width direction collimating step can be performed by the width direction collimating unit, and the length direction light distribution controlling step can be performed by the length direction light distribution controlling unit, the beam size adjusting step can be performed by the beam size adjusting unit, the scanning step can be performed by the scanning unit, and other steps can be performed respectively by the other units.

<Semiconductor Laser Array>

The semiconductor laser array is a semiconductor laser light source in which a plurality of semiconductor lasers are linearly aligned. The semiconductor laser array preferably includes 3 to 300 semiconductor lasers, more preferably 10 to 100 semiconductor lasers.

When the number of the semiconductor lasers for use in the semiconductor laser array is small, the irradiation power may not be increased. When the number of the semiconductor lasers is large, a large scale cooling device for cooling the semiconductor laser array may be required. In order to emit beams from the semiconductor laser array, it is necessary to heat and then cool the semiconductor laser, which may lead an increase in a cost for the apparatus.

The length of the major axis of the emission part of the semiconductor laser array is suitably selected depending on the intended purpose without any restriction. It is preferably 1 mm to 50 mm, more preferably 3 mm to 15 mm. The length of the major axis of the emission part of the semiconductor laser array is less than 1 mm, the irradiation power may not be increased. When the length of the major axis of the emission part of the semiconductor laser array is more than 50 mm, a large scale cooling device for cooling the semiconductor laser array may be required, increasing a cost for the apparatus.

Here, the emission part of the semiconductor laser array means a part which effectively and actually emits a beam in the semiconductor laser array.

The wavelength of the laser beam of the semiconductor laser array is preferably 700 nm or more, more preferably 720 nm or more, and still more preferably 750 nm or more. The maximum wavelength of the laser beam is suitably selected depending on the intended purpose without any restriction. It is preferably 1,500 nm or less, and more preferably 1,300 mm or less, and still more preferably 1,200 nm or less.

The laser beam having a wavelength of shorter than 700 nm in a visible light range causes such problems that the contrast on the thermoreversible recording medium may decrease at the time of image recording, and thermoreversible recording medium may be unintentionally colored. Moreover, the laser beam having a shorter wavelength than that of the visible light range, i.e. the wavelength in an ultraviolet light range, causes such problems that the thermoreversible recording medium may be easily degraded. Moreover, a photothermal conversion material, which is added to the thermoreversible recording medium, requires high decomposition temperature in order to secure durability against repetitive image processing. In the case where an organic coloring matter is used as the photothermal conversion material, it is difficult to obtain a photothermal conversion material having high decomposition temperature and long absorption wavelength. Thus, the wavelength of the laser beam is preferably 1,500 nm or less.

<Width Direction Collimating Step and Width Direction Collimating Unit>

The width direction collimating step is a step of collimating in a width direction broadening of laser beams emitted from a semiconductor laser array, in which a plurality of semiconductor laser light sources are linearly aligned, so as to form a linear beam, and performed by a width direction collimating unit.

The width direction collimating unit is suitably selected depending on the intended purpose without any restriction. Examples thereof include a plano-convex cylindrical lens, a plurality of convex cylindrical lenses, a plurality of concave cylindrical lenses, and combinations thereof.

The laser beam emitted from the semiconductor laser array has a larger diffusion angle in the width direction than that in the length direction. The width direction collimating unit is provided adjacent to an output surface of the semiconductor laser array, so as to prevent broadening of the laser beam in a width direction. Moreover, because the width direction collimating unit is provided adjacent to the output surface of the semiconductor laser array, the lens used for the width direction collimating unit can be small, which is preferable.

<Length Direction Light Distribution Controlling Step Length Direction Light Distribution Controlling Unit>

The length direction light distribution controlling step is a step of controlling the linear beam to have the major axis whose length is longer than the length of the major axis of the emission part of the semiconductor laser array, and uniform light distribution in a length direction of the major axis of the linear beam, and performed by the length direction light distribution controlling unit.

The length direction light distribution controlling unit is suitably selected depending on the intended purpose without any restriction. For example, a combination of two spherical lenses, a non-spherical cylindrical lens (length direction), and a cylindrical lens (width direction) can be used as the length direction light distribution controlling unit. Examples of the non-spherical cylindrical lens (length direction) include Fresnel lens, a convex lens array, and a concave lens array. The lens array means a lens in which a plurality of convex lenses or concave lenses are aligned in the length direction. Through the non-spherical cylindrical lens, light is diffused in the length direction so as to obtain uniform light distribution.

The length direction light distribution controlling unit is provided on an output surface of the width direction collimating unit.

<Beam Size Adjusting Step and Beam Size Adjusting Unit>

The beam size adjusting step is a step of adjusting at least one of the length of the major axis of the linear beam and a length of a minor axis of the linear beam, wherein the linear beam has the major axis whose length is longer than the length of the major axis of the emission part of the semiconductor laser array and uniform light distribution in the length direction of the linear beam, and performed by the beam size adjusting unit.

The beam size adjusting unit is suitably selected depending on the intended purpose without any restriction. Examples thereof include a convex cylindrical lens, a concave cylindrical lens, change of a focal distance of a spherical lens, change of installation position of the lens, change of the distance between the light source and the thermoreversible recording medium, and combinations thereof.

In the present invention, the length of the major axis of the adjusted linear beam is preferably 10 mm to 300 mm, more preferably 30 mm to 160 mm. The area which can be erased is decided depending on the length of the beam. When the area which can be erased is narrow, an area to be erased becomes narrow. When the beam length is excessively long, energy is applied to an area which should not be erased, causing energy loss and damage.

The length of the major axis of the beam is preferably longer than the length of the major axis of the emission part of the semiconductor laser array by two times or more, more preferably by three time or more. When the length of the major axis of the beam is shorter than the length of the major axis of the emission part of the semiconductor laser array, it is necessary to make the length of the major axis of the emission part of the semiconductor laser array longer in order to secure a long area to be erased, causing increase in the cost of and size of the apparatus.

The length of the minor axis of the adjusted linear beam is preferably 0.1 mm to 10 mm, more preferably 0.2 mm to 5 mm. The length of the minor axis of the linear beam can control the time for heating the thermoreversible recording medium. When the length of the minor axis of the linear beam is short, heating time is short, and decoloring properties may decrease. When the length of the minor axis of the linear beam is long, the heating time is long, and an excess energy is applied to the thermoreversible recording medium, and thus, high energy is required for erasure. Consequently, erasure cannot be performed at high speed. It is necessary for the apparatus to adjust the length of the minor axis of the linear beam suitable for decoloring properties of the thermoreversible recording medium.

The output of the thus adjusted linear beam is suitably selected depending on the intended purpose without any restriction. It is preferably 10 W or more, more preferably 20 W or more, and still more preferably 40 W or more. The output of the laser beam is less than 10 W, it takes time to erase an image. When it is tried to shorten the time for erasing an image, the output is not enough to erase an image, failing to erase the image. The maximum output of the laser beam is suitably selected depending on the intended purpose without any restriction. It is preferably 500 W or less, more preferably 200 W or less, still more preferably 120 W or less. When the output of the laser beam is more than 500 W, a cooling device for the light source of the semiconductor laser may increase in size.

<Scanning Step and Scanning Unit>

The scanning step is a step of scanning the thermoreversible recording medium in a uniaxial direction with the linear beam having the major axis whose length is longer than the length of the major axis of the emission part of the semiconductor laser array and uniform light distribution in the length direction of the linear beam, and performed by the scanning unit.

The scanning unit is suitably selected depending on the intended purpose without any restriction, as long as scanning is performed with a linear beam in a uniaxial direction. Examples thereof include a uniaxial galvano mirror, a polygon mirror, and a stepper motor mirror.

By using the uniaxial galvano mirror or the stepper motor mirror, a speed can be finely controlled. The stepper motor mirror is less expensive than the uniaxial galvano mirror. By using the polygon mirror, a speed is hard to control, but the scanning can be performed at low cost.

The scanning velocity of the linear beam is suitably selected depending on the intended purpose without any restriction. It is preferably 2 mm/s or more, more preferably 10 mm/s or more, and still more preferably 20 mm/s or more. When the scanning velocity is less than 2 mm/s, image erasure takes for a long time. The maximum scanning velocity of the laser beam is suitably selected depending on the intended purpose without any restriction. It is preferably 1,000 mm/s or less, more preferably 300 mm/s or less, and still more preferably 100 mm/s or less. When the scanning velocity is more than 1,000 mm/s, it may be hard to erase an image uniformly.

The image erasing apparatus further includes a moving unit configured to move the thermoreversible recording medium with respect to the linear beam having the major axis whose length is longer than the length of the major axis of the emission part of the semiconductor laser array and uniform light distribution in the length direction of the linear beam so that the thermoreversible recording medium is scanned with the linear beam to erase an image recorded on the thermoreversible recording medium. In this case, the thermoreversible recording medium is attached onto a surface of a container, and it is preferred that the moving unit be a conveyor and configured to move the container.

Examples of the container include cardboard boxes, plastic containers and boxes.

<Other Steps and Other Units>

The other steps are suitably selected depending on the intended purpose without any restriction. Examples thereof include a controlling step.

The controlling step is a step of controlling the above-described steps, and performed by a controlling unit.

The controlling unit is suitably selected depending on the intended purpose without any restriction, as long as the operation of the above-described units can be controlled. Examples thereof include devices such as a sequencer, a computer and the like.

<Thermoreversible Recording Medium>

The thermoreversible recording medium is a medium in which any of transparency and color tone reversibly changes depending on temperature.

The thermoreversible recording medium is suitably selected depending on the intended purpose without any restriction. The thermoreversible recording medium preferably includes a support, a first thermoreversible recording layer, a photothermal conversion layer, and a second thermoreversible recording layer in this order over the support, and further includes other layers suitably selected as required such as a first oxygen barrier layer, a second oxygen barrier layer, an ultraviolet absorbing layer, a back layer, a protective layer, an intermediate layer, an under layer, an adhesive layer, a tackiness layer, a coloring layer, an air layer, and a light reflective layer. The first thermoreversible recording layer and the second thermoreversible recording layer may be one thermoreversible recording layer without forming the photothermal conversion layer, by adding a photothermal conversion material to a thermoreversible recording layer. Each of these layers may be formed in a single layer structure or a multi-layered structure, provided that as for layers which are provided over the photothermal conversion layer, in order to reduce energy loss of a laser beam with a specific wavelength irradiated, each of them preferably formed of a material of less absorbing light of the specific wavelength.

Figure 4A:
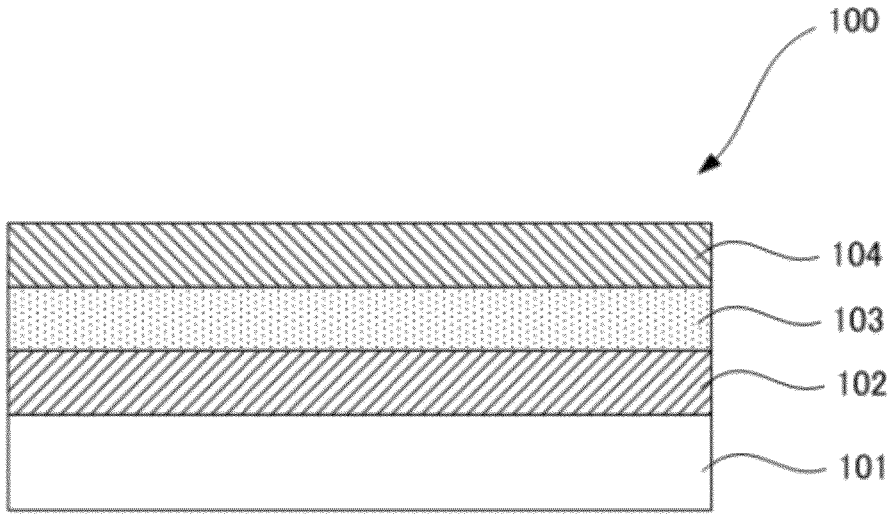
FIG. 4A is a cross-sectional view showing an example of a layer structure of a thermoreversible recording medium used in the present invention.

Here, the layer configuration of a thermoreversible recording medium 100 is not particularly limited, for example, as illustrated in FIG. 4A, an aspect of the layer configuration is exemplified in which the thermoreversible recording medium 100 has a support 101, and a first thermoreversible recording layer 102, a photothermal conversion layer 103, and a second thermoreversible recording layer 104 in this order over the support 101.

Figure 4B:
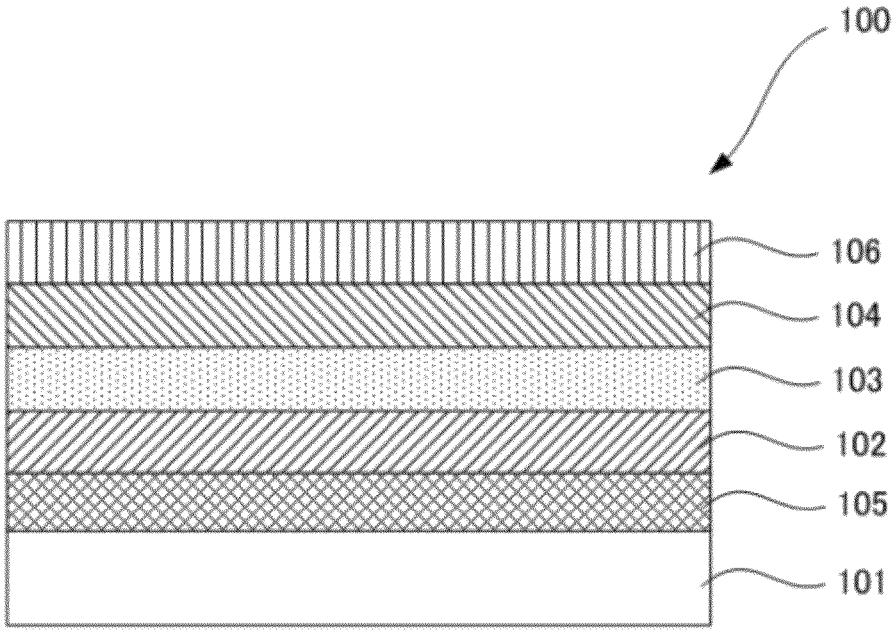
FIG. 4B is a cross-sectional view showing another example of the layer structure of the thermoreversible recording medium used in the present invention.

Further, as illustrated in FIG. 4B, an aspect of the layer configuration is exemplified in which a thermoreversible recording medium 100 has a support 101, a first oxygen barrier layer 105, a first thermoreversible recording layer 102, a photothermal conversion layer 103, a second thermoreversible recording layer 104, and a second oxygen barrier layer 106 in this order over the support 101.

Figure 4C:
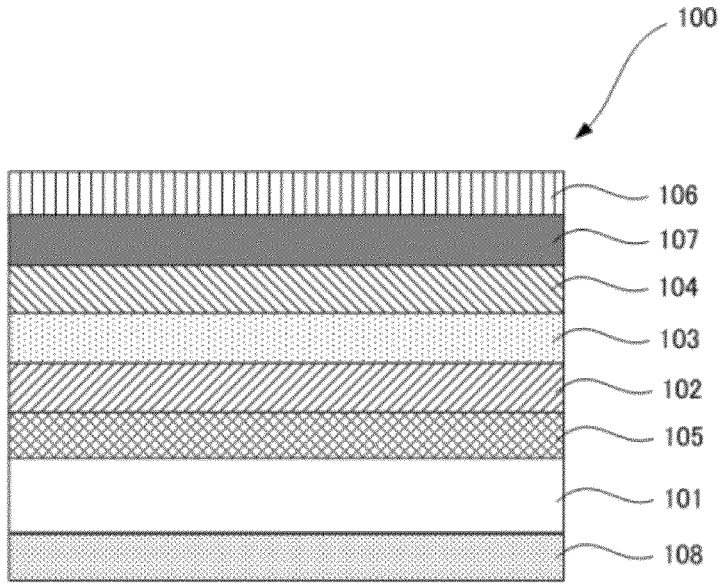
FIG. 4C is a cross-sectional view showing still another example of the layer structure of the thermoreversible recording medium used in the present invention.

Furthermore, as illustrated in FIG. 4C, an aspect of the layer configuration is exemplified in which a thermoreversible recording medium 100 has a support 101, a first oxygen barrier layer 105, a first thermoreversible recording layer 102, a photothermal conversion layer 103, a second thermoreversible recording layer 104, an ultraviolet absorbing layer 107, a second oxygen barrier layer 106 in this order over the support 101, and further has a back layer 108 on the surface of the support 101 opposite to the surface over which the thermoreversible recording layer and the like are formed.

Note that although illustration is omitted, a protective layer may be formed on the second thermoreversible recording layer 104 in FIG. 4A, on the second oxygen barrier layer 106 in FIG. 4B, and the second oxygen barrier layer 106 in FIG. 4C, each serving as an uppermost surface layer.

—Support—

The shape, structure, size and the like of the support are suitably selected depending on the intended purpose without any restriction. Examples of the shape include plate-like shapes; the structure may be a single-layer structure or a laminated structure; and the size may be suitably selected according to the size of the thermoreversible recording medium, etc.

Examples of the material for the support include inorganic materials and organic materials.

Examples of the inorganic materials include glass, quartz, silicon, silicon oxide, aluminum oxide, $SiO_2$ and metals.

Examples of the organic materials include paper, cellulose derivatives such as cellulose triacetate, synthetic paper, and films made of polyethylene terephthalate, polycarbonates, polystyrene, polymethyl methacrylate, etc.

Each of the inorganic materials and the organic materials may be used alone or in combination. Among these materials, the organic materials are preferable, specifically films made of polyethylene terephthalate, polycarbonates, polymethyl methacrylate, etc. are preferable. Of these, polyethylene terephthalate is particularly preferable.

It is desirable that the support be subjected to surface modification by means of corona discharge, oxidation reaction (using chromic acid, for example), etching, facilitation of adhesion, antistatic treatment, etc. for the purpose of improving the adhesiveness of a coating layer.

Also, it is desirable to color the support white by adding, for example, a white pigment such as titanium oxide to the support.

The thickness of the support is suitably selected depending on the intended purpose without any restriction, with the range of 10 μm to 2,000 μm being preferable and the range of 50 μm to 1,000 μm being more preferable.

—First Thermoreversible Recording Layer and Second Thermoreversible Recording Layer—

The first and second thermoreversible recording layers (which may be hereinafter referred to simply as "thermoreversible recording layer") includes a leuco dye serving as an electron-donating color-forming compound and a developer serving as an electron-accepting compound, in which color tone reversibly changes by heat, and a binder resin, and further includes other components in accordance with the necessity.

The leuco dye serving as an electron-donating color-forming compound and reversible developer serving as an electron-accepting compound, in which color tone reversibly changes by heat are materials capable of exhibiting a phenomenon in which visible changes are reversibly produced by temperature change; and the material can relatively change into a colored state and into a decolored state, depending upon the heating temperature and the cooling rate after heating.

—Leuco Dye—

The leuco dye is a dye precursor which is colorless or pale per se. The leuco dye is suitably selected from known leuco dyes without any restriction. Examples thereof include leuco compounds based upon triphenylmethane phthalide, triallylmethane, fluoran, phenothiazine, thiofluoran, xanthene, indophthalyl, spiropyran, azaphthalide, chromenopyrazole, methines, rhodamineanilinolactam, rhodaminelactam, quinazoline, diazaxanthene and bislactone. Among these, leuco dyes based upon fluoran and phthalide are particularly preferable in that they are excellent in coloring and decoloring properties, colorfulness and storage ability. Each of these may be used alone or in combination, and the thermoreversible recording medium can be made suitable for multicolor or full-color recording by providing a layer which color-forms with a different color tone.

—Reversible Developer—

The reversible developer is suitably selected depending on the intended purpose without any restriction, provided that it is capable of reversibly developing and erasing color by means of heat. Suitable examples thereof include a compound having in its molecules at least one of the following structures: a structure (1) having such a color-developing ability as makes the leuco dye develop color (for example, a phenolic hydroxyl group, a carboxylic acid group, a phosphoric acid group, etc.); and a structure (2) which controls cohesion among molecules (for example, a structure in which long-chain hydrocarbon groups are linked together). In the bonded site, the long-chain hydrocarbon group may be bonded via a divalent or higher bond group containing a hetero atom. Additionally, the long-chain hydrocarbon groups may contain at least either similar linking groups or aromatic groups.

For the structure (1) having such a color-developing ability as making the leuco dye develop color, phenol is particularly suitable.

The structure (2) which controls cohesion among molecules is long-chain hydrocarbon groups having 8 or more carbon atoms, more preferably 11 or more carbon atoms, and the upper limit of the number of carbon atoms is preferably 40 or less, more preferably 30 or less.

Of the reversible developers, a phenol compound expressed by General Formula (1) is preferable, and a phenol compound expressed by General Formula (2) is more preferable.

General Formula (1)

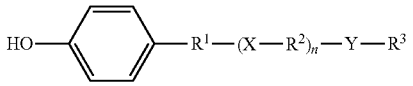

General Formula (2)

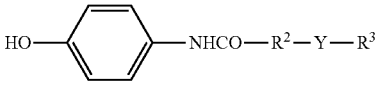

In General Formulae (1) and (2), $R^1$ denotes a single bond or an aliphatic hydrocarbon group having 1 to 24 carbon atoms. $R^2$ denotes an aliphatic hydrocarbon group having two or more carbon atoms, which may have a substituent, and the number of the carbon atoms is preferably 5 or greater, more preferably 10 or greater. $R^3$ denotes an aliphatic hydrocarbon group having 1 to 35 carbon atoms, and the number of the carbon atoms is preferably 6 to 35, more preferably 8 to 35. Each of these aliphatic hydrocarbon groups may be provided alone or in combination.

The sum of the numbers of carbon atoms of $R^1$, $R^2$ and $R^3$ have is suitably selected depending on the intended purpose without any restriction, with its lower limit being preferably 8 or greater, more preferably 11 or greater, and its upper limit being preferably 40 or less, more preferably 35 or less.

When the sum of the numbers of carbon atoms is less than 8, coloring stability or decoloring properties may degrade.

Each of the aliphatic hydrocarbon groups may be a straight-chain group or a branched-chain group and may have an unsaturated bond, with preference being given to a straight-chain group. Examples of the substituent bonded to the aliphatic hydrocarbon group include a hydroxyl group, halogen atoms and alkoxy groups.

X and Y may be identical or different, each denoting an N atom-containing or O atom-containing divalent group. Specific examples thereof include an oxygen atom, amide group, urea group, diacylhydrazine group, diamide oxalate group and acylurea group, with amide group and urea group being preferable.

"n" denotes an integer of 0 to 1.

It is desirable that the electron-accepting compound (developer) be used together with a compound as a color erasure accelerator having in its molecules at least one of —NHCO— group and —OCONH— group because intermolecular interaction is induced between the color erasure accelerator and the developer in a process of producing a decolored state and thus there is an improvement in coloring and decoloring properties.

The color erasure accelerator is suitably selected depending on the intended purpose without any restriction.

For the thermoreversible recording layer, a binder resin and, if necessary, additives for improving or controlling the coating properties and coloring and decoloring properties of the thermoreversible recording layer may be used. Examples of these additives include a surfactant, a conductive agent, a filling agent, an antioxidant, a light stabilizer, a coloring stabilizer and a color erasure accelerator.

—Binder Resin—

The binder resin is suitably selected depending on the intended purpose without any restriction, provided that it enables the thermoreversible recording layer to be bonded onto the support. For instance, one of conventionally known resins or a combination of two or more thereof may be used for the binder resin. Among these resins, resins capable of being cured by heat, an ultraviolet ray, an electron beam or the like are preferable in that the durability at the time of repeated use can be improved, with particular preference being given to thermosetting resins each containing an isocyanate compound or the like as a cross-linking agent. Examples of the thermosetting resins include a resin having a group which reacts with a cross-linking agent, such as a hydroxyl group or carboxyl group, and a resin produced by copolymerizing a hydroxyl group-containing or carboxyl group-containing monomer and other monomer. Specific examples of such thermosetting resins include phenoxy resins, polyvinyl butyral resins, cellulose acetate propionate resins, cellulose acetate butyrate resins, acrylpolyol resins, polyester polyol resins and polyurethane polyol resins, with particular preference being given to acrylpolyol resins, polyester polyol resins and polyurethane polyol resins.

The mixture ratio (mass ratio) of the color former to the binder resin in the thermoreversible recording layer is preferably in the range of 1:0.1 to 1:10. When the amount of the binder resin is too small, the thermoreversible recording layer may be deficient in thermal strength. When the amount of the binder resin is too large, it is problematic because the coloring density decreases.

The cross-linking agent is suitably selected depending on the intended purpose without any restriction, and examples thereof include isocyanates, amino resins, phenol resins, amines and epoxy compounds. Among these, isocyanates are preferable, and polyisocyanate compounds each having a plurality of isocyanate groups are particularly preferable.

The amount of the cross-linking agent added relative to the amount of the binder resin is suitably selected depending on the intended purpose without any restriction. The ratio of the number of functional groups contained in the cross-linking agent to the number of active groups contained in the binder resin is preferably in the range of 0.01:1 to 2:1. When the amount of the cross-linking agent added is so small as to be outside this range, sufficient thermal strength cannot be obtained. When the amount of the cross-linking agent added is so large as to be outside this range, there is an adverse effect on the coloring and decoloring properties.

Further, as a cross-linking promoter, a catalyst utilized in this type of reaction may be used.

The gel fraction of any of the thermosetting resins in the case where thermally cross-linked is suitably selected depending on the intended purpose without any restriction. It is preferably 30% or greater, more preferably 50% or greater, still more preferably 70% or greater. When the gel fraction is less than 30%, an adequate cross-linked state cannot be produced, and thus there may be degradation of durability.

As to a method for distinguishing between a cross-linked state of the binder resin and a non-cross-linked state thereof, these two states can be distinguished by immersing a coating film in a solvent having high dissolving ability, for example. Specifically, with respect to the binder resin in a non-cross-linked state, the resin dissolves in the solvent and thus does not remain in a solute.

The other components in the thermoreversible recording layer are suitably selected depending on the intended purpose without any restriction. For instance, a surfactant, a plasticizer and the like are suitable therefor in that recording of an image can be facilitated.

To a solvent, a coating solution dispersing device, an application method, a drying and hardening method and the like used for the thermoreversible recording layer coating solution.

To prepare the thermoreversible recording layer coating solution, materials may be together dispersed into a solvent using the dispersing device; alternatively, the materials may be independently dispersed into respective solvents and then the solutions may be mixed together. Further, the materials may be heated and dissolved, and then they may be precipitated by rapid cooling or slow cooling.

The method for forming the thermoreversible recording layer is suitably selected depending on the intended purpose without any restriction. Suitable examples thereof include a method (1) of applying onto a support a thermoreversible recording layer coating solution in which the resin, the leuco dye and the reversible developer are dissolved or dispersed in a solvent, then cross-linking the coating solution while or after forming it into a sheet or the like by evaporation of the solvent; a method (2) of applying onto a support a thermoreversible recording layer coating solution in which the leuco dye and the reversible developer are dispersed in a solvent in which only the resin is dissolved, then cross-linking the coating solution while or after forming it into a sheet or the like by evaporation of the solvent; and a method (3) of not using a solvent and heating and melting the resin, the leuco dye and the reversible developer so as to mix, then cross-linking this melted mixture after forming it into a sheet or the like and cooling it. In each of these methods, it is also possible to produce the thermoreversible recording layer as a thermoreversible recording medium in the form of a sheet without using the support.

The solvent used in the method (1) or (2) cannot be unequivocally defined, as it is affected by the types, etc. of the resin, the leuco dye and the reversible developer. Examples thereof include tetrahydrofuran, methyl ethyl ketone, methyl isobutyl ketone, chloroform, carbon tetrachloride, ethanol, toluene and benzene.

Additionally, the reversible developer is present in the thermoreversible recording layer, being dispersed in the form of particles.

A pigment, an antifoaming agent, a dispersant, a slip agent, an antiseptic agent, a cross-linking agent, a plasticizer and the like may be added into the thermoreversible recording layer coating solution, for the purpose of exhibiting high performance as a coating material.

The coating method for the thermoreversible recording layer is suitably selected depending on the intended purpose without any restriction. For instance, a support which is continuous in the form of a roll or which has been cut into the form of a sheet is conveyed, and the support is coated with the thermoreversible recording layer by a known method such as blade coating, wire bar coating, spray coating, air knife coating, bead coating, curtain coating, gravure coating, kiss coating, reverse roll coating, dip coating or die coating.

The drying conditions of the thermoreversible recording layer coating solution are suitably selected depending on the intended purpose without any restriction. For instance, the recording layer coating solution is dried at room temperature to a temperature of 140° C., for approximately 10 sec to 10 min.

The thickness of the thermoreversible recording layer is suitably selected depending on the intended purpose without any restriction. For instance, it is preferably 1 μm to 20 μm, more preferably 3 μm to 15 μm. When the thermoreversible recording layer is too thin, the contrast of an image may lower because the coloring density lowers. When the recording layer is too thick, the heat distribution in the layer increases, a portion which does not reach a coloring temperature and so does not form color is created, and thus a desired coloring density may be unable to be obtained.

Note that a photothermal conversion material can be added to the thermoreversible recording layer, and in that case, it is not necessary to form the photothermal conversion layer and the barrier layer and the first and second thermoreversible recording layers can be replaced with one thermoreversible recording layer.

—Photothermal Conversion Layer—

The photothermal conversion layer contains at least a photothermal conversion material having a function to absorb a laser light with high efficiency and generate heat. A barrier layer may be formed between the thermoreversible recording layer and the photothermal conversion layer for the purpose of inhibiting an interaction therebetween. The barrier layer is preferably formed by using a material having high thermal conductivity. The layer deposited between the thermoreversible recording layer and the photothermal conversion layer is suitably selected depending on the intended purpose without any restriction.

The photothermal conversion material is broadly classified into inorganic materials and organic materials.

Examples of the inorganic materials include carbon black, metals such as Ge, Bi, In, Te, Se, and Cr, or semi-metals thereof, alloys thereof, and lanthanum boride, tungsten oxide, ATO, and ITO. Each of these inorganic materials is formed into a layer form by vacuum evaporation method or by bonding a particulate material using a resin or the like.

For the organic material, various dyes can be suitably used in accordance with the wavelength of light to be absorbed, however, when a laser diode is used as a light source, a near-infrared absorption pigment having an absorption peak within wavelengths of 700 nm to 1,500 nm is used. Specific examples thereof include cyanine pigments, quinone pigments, quinoline derivatives of indonaphthol, phenylene diamine nickel complexes, and phthalocyanine compounds. To perform repetitive image processing, it is preferable to select a photothermal conversion material that is excellent in heat resistance, with particular preference being given to phthalocyanine compounds.

Each of the near-infrared absorption pigments may be used alone or in combination.

When the photothermal conversion layer is formed, the photothermal conversion material is typically used in combination with a resin. The resin used in the photothermal conversion layer is suitably selected from among those known in the art without any restriction, provided that it can maintain the inorganic material and the organic material therein, however, thermoplastic resins and thermosetting resins are preferable, and those similar to the binder resin used in the thermoreversible recording layer can be suitably used. Among them, resins curable with the application of heat, ultraviolet light, or an electron beam can be preferably used for improving the durability against the repetitive use, and a thermal crosslinkable resin using an isocyanate compound as a crosslinking agent is particularly preferable. The binder resin preferably has a hydroxyl value of 50 mgKOH/g to 400 mgKOH/g.

The thickness of the photothermal conversion layer is suitably selected depending on the intended purpose without any restriction, but is preferably 0.1 μm to 20 μm.

—First and Second Oxygen Barrier Layers—

It is preferable that the first and second oxygen barrier layers (hereinafter, may be simply referred to as barrier layer) are formed over and under the first and second thermoreversible recording layer, respectively so as to prevent the oxygen from entering the thermoreversible recording medium to thereby prevent the photodeterioration of the leuco dye contained in the first and second thermoreversible recording layers. Namely, it is preferable that the first oxygen barrier layer is formed between the support and the first thermoreversible recording layer, and the second oxygen barrier layer is formed over the second thermoreversible recording layer.

The materials for forming the first and second oxygen barrier layers are suitably selected depending on the intended purpose without any restriction. Examples thereof include resins and polymer films, each of which has a large transmittance with visible light and low oxygen permeation. The oxygen barrier layer is selected depending on the use thereof, oxygen permeation, transparency, easiness of coating, adhesiveness, and the like.

Specific examples of the oxygen barrier layer include a silica deposited film, an alumina deposited film, and a silica-alumina deposited film in all of which inorganic oxide is vapor deposited on a resin or polymer film. Here, examples of the resin include polyalkyl acrylate, polyalkyl methacrylate, polymethachloronitrile, polyalkylvinyl ester, polyalkylvinyl ether, polyvinyl fluoride, polystyrene, an acetic acid-vinyl copolymer, cellulose acetate, polyvinyl alcohol, polyvinylidene chloride, an acetonitrile copolymer, a vinylidene chloride copolymer, poly(chlorotrifluoroethylene), an ethylene-vinyl alcohol copolymer, polyacrylonitrile, an acrylonitrile copolymer, polyethylene terephthalate, nylon-6, and polyacetal, and examples of the polymer include polyethylene terephthalate and nylon. Among them the film in which the inorganic oxide is deposited on the polymer film is preferable.

The oxygen permeability of the oxygen barrier layer is not particularly limited, and it is preferably 20 $mL/m^2/day/MPa$ or less, more preferably 5 $mL/m^2/day/MPa$ or less, still more preferably 1 $mL/m^2/day/MPa$ or less. When the oxygen permeability thereof is more than 20 $mL/m^2/day/MPa$, the photodeterioration of the leuco dye contained in the first and second thermoreversible recording layers may not be prevented.

The oxygen permeability can be measured, for example, by the measuring method in accordance with JIS K7126 B.

The oxygen barrier layers can be formed so as to sandwich the thermoreversible recording layer, for example, one of the oxygen barrier layers is formed under the thermoreversible recording layer or on the back surface of the support. By disposing the oxygen barrier layer in this manner, the oxygen is efficiently prevented from entering the thermoreversible recording layer, and thus the photodeterioration of the leuco dye can be suppressed.

The method for forming the first and second oxygen barrier layer is suitably selected depending on the indented purpose without any restriction. Examples thereof include melt extrusion, coating, laminating, and the like.

The thickness of each of the first and second oxygen barrier layers varies depending on the oxygen permeability of the resin or polymer film, but is preferably 0.1 μm to 100 μm. When the thickness thereof is less than 0.1 μm, oxygen barrier properties are insufficient. When the thickness thereof is more than 100 μm, it is not preferable as the transparency thereof is lowered.

An adhesive layer may be formed between the oxygen barrier layer and the underlying layer. The method for forming the adhesive layer is not particularly limited, and examples thereof include coating, and laminating. The thickness of the adhesive layer is not particularly limited, but is preferably 0.1 μm to 5 μm. The adhesive layer may be cured with a crosslinking agent. As the crosslinking agent, those used in the thermoreversible recording layer can be suitably used.

—Protective Layer—

In the thermoreversible recording medium of the present invention, it is desirable that a protective layer be provided on the thermoreversible recording layer, for the purpose of protecting the thermoreversible recording layer. The protective layer is suitably selected depending on the intended purpose without any restriction. For instance, the protective layer may be formed from one or more layers, and it is preferably provided on the outermost surface that is exposed.

The protective layer contains a binder resin and further contains other components such as a filler, a lubricant and a coloring pigment as necessary.

The binder resin in the protective layer is suitably selected depending on the intended purpose without any restriction. For instance, the resin is preferably a thermosetting resin, an ultraviolet (UV) curable resin, an electron beam curable resin, etc., with particular preference being given to an ultraviolet (UV) curable resin and a thermosetting resin.

The UV-curable resin can form a very hard film after cured, and reducing damage done by physical contact of the surface and deformation of the medium caused by laser heating; therefore, it is possible to obtain a thermoreversible recording medium superior in durability against repeated use.

Although slightly inferior to the UV-curable resin, the thermosetting resin makes it possible to harden the surface as well and is superior in durability against repeated use.

The UV-curable resin is suitably selected from known UV-curable resins depending on the intended purpose without any restriction. Examples thereof include oligomers based upon urethane acrylates, epoxy acrylates, polyester acrylates, polyether acrylates, vinyls and unsaturated polyesters; and monomers such as monofunctional and multifunctional acrylates, methacrylates, vinyl esters, ethylene derivatives and allyl compounds. Of these, multifunctional, i.e. tetrafunctional or higher, monomers and oligomers are particularly preferable. By mixing two or more of these monomers or oligomers, it is possible to suitably adjust the hardness, degree of contraction, flexibility, coating strength, etc. of the resin film.

To cure the monomers and the oligomers with an ultraviolet ray, it is necessary to use a photopolymerization initiator or a photopolymerization accelerator.

The amount of the photopolymerization initiator or the photopolymerization accelerator added is not particularly limited and it is preferably 0.1% by mass to 20% by mass, more preferably 1% by mass to 10% by mass, in relation to the total mass of the resin component of the protective layer.

Ultraviolet irradiation for curing the ultraviolet curable resin can be conducted using a known ultraviolet irradiator, and examples of the ultraviolet irradiator include one equipped with a light source, a lamp fitting, a power source, a cooling device, a conveyance device, etc.

Examples of the light source include a mercury-vapor lamp, a metal halide lamp, a potassium lamp, a mercury-xenon lamp and a flash lamp. The wavelength of the light source may be suitably selected according to the ultraviolet absorption wavelength of the photopolymerization initiator and the photopolymerization accelerator added to the thermoreversible recording medium composition.

The conditions of the ultraviolet irradiation are suitably selected depending on the intended purpose without any restriction. For instance, it is advisable to decide the lamp output, the conveyance speed, etc. according to the irradiation energy necessary to cross-link the resin.

In order to improve the conveyance capability, a releasing agent such as a silicone having a polymerizable group, a silicone-grafted polymer, wax or zinc stearate; or a lubricant such as silicone oil may be added. The amount of any of these added is preferably 0.01% by mass to 50% by mass, more preferably 0.1% by mass to 40% by mass, relative to the total mass of the resin component of the protective layer. Each of these may be used alone or in combination. Additionally, in order to prevent static electricity, a conductive filler is preferably used, a needle-like conductive filler is more preferably used.

The particle diameter of the filler is preferably 0.01 μm to 10.0 μm, more preferably 0.05 μm to 8.0 μm. The amount of the filler added is preferably 0.001 parts by mass to 2 parts by mass, more preferably 0.005 parts by mass to 1 part by mass, relative to 1 part by mass of the resin.

Further, a surfactant, a leveling agent, an antistatic agent and the like that are conventionally known may be contained in the protective layer as additives.

Also, as the thermosetting resin, a resin similar to the binder resin used for the thermoreversible recording layer can be suitably used, for instance.

It is desirable that the thermosetting resin be cross-linked. Accordingly, the thermosetting resin is preferably a resin having a group which reacts with a curing agent, such as hydroxyl group, amino group or carboxyl group, particularly preferably a hydroxyl group-containing polymer. To increase the strength of a layer which contains the polymer having an ultraviolet absorbing structure, use of the polymer having a hydroxyl value of 10 mgKOH/g or greater is preferable because adequate coating strength can be obtained, more preferably use of the polymer having a hydroxyl value of 30 mgKOH/g or greater, still more preferably use of the polymer having a hydroxyl value of 40 mgKOH/g or greater. By making the protective layer have adequate coating strength, it is possible to prevent degradation of the thermoreversible recording medium even when erasure and printing are repeatedly carried out.

The curing agent is not particularly limited, and for example, a curing agent similar to the one used for the thermoreversible recording layer can be suitably used.

A solvent, a coating solution dispersing device, a protective layer applying method, a drying method and the like used for the protective layer coating solution are not particularly limited and suitably selected from those known and used for the recording layer can be applied. When an ultraviolet curable resin is used, a curing step by means of the ultraviolet irradiation with which coating and drying have been carried out is required, in which case an ultraviolet irradiator, a light source and the irradiation conditions are as described above.

The thickness of the protective layer is not particularly limited and it is preferably 0.1 μm to 20 μm, more preferably 0.5 μm to 10 μm, still more preferably 1.5 μm to 6 μm. When the thickness is less than 0.1 μm, the protective layer cannot fully perform the function as a protective layer of the thermoreversible recording medium, the thermoreversible recording medium easily degrades through repeated use by heat, and thus it may become unable to be repeatedly used. When the thickness is greater than 20 μm, it is impossible to pass adequate heat to a thermosensitive section situated under the protective layer, and thus recording and erasure of an image by heat may become unable to be sufficiently performed.

—Ultraviolet Absorbing Layer—

An ultraviolet absorbing layer is preferably formed for preventing residual images due to photodeterioration thereof and preventing coloring of the leuco dye contained in the thermoreversible recording layer by ultraviolet light. With ultraviolet absorbing layer, the light resistance of the recording medium is improved. It is preferred that the thickness of the ultraviolet absorbing layer be appropriately selected so as to absorb ultraviolet light having a wavelength of 390 nm or shorter.

The ultraviolet absorbing layer contains at least a binder resin and an ultraviolet absorber, and may further contain other components such as fillers, lubricants, color pigments and the like, if necessary.

The binder resin is suitably selected depending on the intended purpose without any restriction. The binder resin used in the thermoreversible recording layer, or resin components such as thermoplastic resins and thermosetting resins can be used as the binder resin. Examples of the resin components include polyethylene, polypropylene, polystyrene, polyvinyl alcohol, polyvinyl butyral, polyurethane, saturated polyester, unsaturated polyester, epoxy resins, phenol resins, polycarbonate, and polyamide.

The ultraviolet absorber may be of an organic compound or an inorganic compound.

Moreover, it is preferable to use a polymer having an ultraviolet absorbing structure (hereinafter, may be referred as "ultraviolet absorbing polymer"), as the ultraviolet absorber.

Here, the polymer having the ultraviolet absorbing structure means a polymer having an ultraviolet absorbing structure (e.g. an ultraviolet absorbing group) in a molecule thereof. Examples of the ultraviolet absorbing structure include a salicylate structure, a cyanoacrylate structure, a benzotriazol structure, and a benzophenone structure. Among them, the benzotriazol structure and the benzophenone structure are particularly preferable as they absorb the ultraviolet light having a wavelength of 340 nm to 400 nm which is a factor to cause a photodeterioration of the leuco dye.

The ultraviolet absorbing polymer is preferably crosslinked. Accordingly, it is preferable that those having a group reactive to a setting agent, such as a hydroxyl group, amino group and carboxyl group, are used as the ultraviolet absorbing polymer, and the polymer having a hydroxyl group is particularly preferable. In order to increase a physical strength of the layer containing the polymer having the ultraviolet absorbing structure, use of the polymer having a hydroxyl value of 10 mgKOH/g or more provides a sufficient coating film strength, more preferably 30 mgKOH/g or more, still more preferably 40 mgKOH/g or more. By giving the sufficient coating film strength, the deterioration of the recording medium can be suppressed even after erasing and printing are repeatedly performed.

The thickness of the ultraviolet absorbing layer is not particularly limited and it is preferably 0.1 μm to 30 μm, more preferably 0.5 μm to 20 μm. As a solvent used for a ultraviolet absorbing layer coating solution, a dispersing device for the coating solution, a coating method of the ultraviolet absorbing layer, a drying and curing method of the ultraviolet absorbing layer and the like, those known used for the thermoreversible recording layer can be used.

—Intermediate Layer—

The thermoreversible recording medium is not particularly limited, and it is desirable to provide an intermediate layer between the thermoreversible recording layer and the protective layer, for the purpose of improving adhesiveness between the thermoreversible recording layer and the protective layer, preventing change in the quality of the recording layer caused by application of the protective layer, and preventing the additives in the protective layer from transferring to the recording layer. This makes it possible to improve the ability to store a colored image.

The intermediate layer contains at least a binder resin and further contains other components such as a filler, a lubricant and a coloring pigment in accordance with the necessity.

The binder resin is suitably selected depending on the intended purpose without any restriction. For the binder resin, the binder resin used for the recording layer or a resin component such as a thermoplastic resin or thermosetting resin may be used. Examples of the resin component include polyethylene, polypropylene, polystyrene, polyvinyl alcohol, polyvinyl butyral, polyurethane, saturated polyesters, unsaturated polyesters, epoxy resins, phenol resins, polycarbonates and polyamides.

It is desirable that the intermediate layer contain an ultraviolet absorber. For the ultraviolet absorber, any one of an organic compound and an inorganic compound may be used.

Also, an ultraviolet absorbing polymer may be used, and this may be cured by means of a cross-linking agent. As these compounds, compounds similar to those used for the protective layer can be suitably used.

The thickness of the intermediate layer is preferably 0.1 μm to 20 μm, more preferably 0.5 μm to 5 μm. To a solvent, a coating solution dispersing device, an intermediate layer applying method, an intermediate layer drying and hardening method and the like used for the intermediate layer coating solution, those that are known and used for the thermoreversible recording layer can be applied.

—Under Layer—

An under layer may be provided between the thermoreversible recording layer and the support, for the purpose of effectively utilizing applied heat for high sensitivity, or improving adhesiveness between the support and the thermoreversible recording layer, and preventing permeation of recording layer materials into the support.

The under layer contains at least hollow particles, also contains a binder resin and further contains other components in accordance with the necessity.

Examples of the hollow particles include single hollow particles in which only one hollow portion is present in each particle, and multi hollow particles in which numerous hollow portions are present in each particle. These types of hollow particles may be used alone or in combination.

The material for the hollow particles is suitably selected depending on the intended purpose without any restriction, and suitable examples thereof include thermoplastic resins. For the hollow particles, suitably produced hollow particles may be used, or a commercially available product may be used. Examples of the commercially available product include MICROSPHERE R-300 (manufactured by Matsumoto Yushi-Seiyaku Co., Ltd.); ROPAQUE HP1055 and ROPAQUE HP433J (both of which are manufactured by Zeon Corporation); and SX866 (manufactured by JSR Corporation).

The amount of the hollow particles added to the under layer is suitably selected depending on the intended purpose without any restriction, and it is preferably 10% by mass to 80% by mass, for instance.

For the binder resin, a resin similar to the resin used for the thermoreversible recording layer or used for the layer which contains the polymer having an ultraviolet absorbing structure can be used.

The under layer may contain at least one of an organic filler and an inorganic filler such as calcium carbonate, magnesium carbonate, titanium oxide, silicon oxide, aluminum hydroxide, kaolin or talc.

Besides, the under layer may contain a lubricant, a surfactant, a dispersant and so forth.

The thickness of the under layer is suitably selected depending on the intended purpose without any restriction, with the range of 0.1 μm to 50 μm being preferable, the range of 2 μm to 30 μm being more preferable, and the range of 12 μm to 24 μm being still more preferable.

—Back Layer—

In the present invention, for the purpose of preventing curl and static charge on the thermoreversible recording medium and improving the conveyance capability, a back layer may be provided on the surface of the support opposite to the surface where the thermoreversible recording layer is formed.

The back layer is suitably selected depending on the intended purpose without any restriction. The back layer contains at least a binder resin and further contains other components such as a filler, a conductive filler, a lubricant and a coloring pigment in accordance with the necessity.

The binder resin is suitably selected depending on the intended purpose without any restriction. For instance, the binder resin is any one of a thermosetting resin, an ultraviolet (UV) curable resin, an electron beam curable resin, etc., with particular preference being given to an ultraviolet (UV) curable resin and a thermosetting resin.

For the ultraviolet curable resin, the thermosetting resin, the filler, the conductive filler and the lubricant, ones similar to those used for the recording layer, the protective layer or the intermediate layer can be suitably used.

—Adhesive Layer or Tackiness Layer—

The thermoreversible recording medium can be produced as a thermoreversible recording label by providing an adhesive layer or a tackiness layer on the surface of the support opposite to the surface where the recording layer is formed.

The material for the adhesive layer or the tackiness layer can be selected from commonly used materials depending on the intended purpose without any restriction.

The material for the adhesive layer or the tackiness layer may be of a hot-melt type. Release paper may or may not be used. By thusly providing the adhesive layer or the tackiness layer, the thermoreversible recording label can be affixed to a whole surface or a part of a thick substrate such as a magnetic stripe-attached vinyl chloride card, which is difficult to coat with a recording layer. This makes it possible to improve the convenience of this medium, for example to display part of information stored in a magnetic recorder.

The thermoreversible recording label provided with such an adhesive layer or tackiness layer can also be used on thick cards such as IC cards and optical cards.

—Coloring Layer—

In the thermoreversible recording medium, a coloring layer may be provided between the support and the recording layer, for the purpose of improving visibility.

The coloring layer can be formed by applying a dispersion solution or a solution containing a colorant and a resin binder over a target surface and drying the dispersion solution or the solution; alternatively, the coloring layer can be formed by simply bonding a coloring sheet to the target surface.

The coloring layer may be provided with a color printing layer. A colorant in the color printing layer is, for example, selected from dyes, pigments and the like contained in color inks used for conventional full-color printing.

Examples of the resin binder include thermoplastic resins, thermosetting resins, ultraviolet curable resins and electron beam curable resins.

The thickness of the color printing layer may be suitably selected according to the desired printed color density without any restriction.

In the thermoreversible recording medium, an irreversible recording layer may be additionally used. In this case, the colored color tones of the recording layers may be identical or different.

Also, a coloring layer which has been printed with any pictorial design or the like by offset printing, gravure printing, etc. or using an ink-jet printer, a thermal transfer printer, a sublimation printer, etc., for example, may be provided on the whole or a part of the same surface of the thermoreversible recording medium of the present invention as the surface where the recording layer is formed, or may be provided on a part of the opposite surface thereof. Further, an OP varnish layer composed mainly of a curable resin may be provided on a part or the whole surface of the coloring layer.

Examples of the pictorial design include letters/characters, patterns, diagrams, photographs, and information detected with an infrared ray.

Also, any of the layers that are simply formed may be colored by addition of dye or pigment.

Further, the thermoreversible recording medium of the present invention may be provided with a hologram for security. Also, to give variety in design, it may also be provided with a design such as a portrait, a company emblem or a symbol by forming depressions and protrusions in relief or in intaglio.

—Formation and Application of Thermoreversible Recording Medium—

The thermoreversible recording medium may be formed into a desired shape according to its use, for example into a card shape, a tag shape, a label shape, a sheet shape or a roll shape.

The thermoreversible recording medium in the form of a card can be used for prepaid cards, discount cards, i.e. so-called point cards, credit cards and the like.

The thermoreversible recording medium in the form of a tag that is smaller in size than the card can be used for price tags and the like. The thermoreversible recording medium in the form of a tag that is larger in size than the card can be used for tickets, sheets of instruction for process control and shipping, and the like.

The thermoreversible recording medium in the form of a label can be affixed; accordingly, it can be formed into a variety of sizes and, for example, used for process control and product control, being affixed to carts, receptacles, boxes, containers, etc. to be repeatedly used. The thermoreversible recording medium in the form of a sheet that is larger in size than the card offers a larger area for image formation, and thus it can be used for general documents and sheets of instruction for process control, for example.

—Thermoreversible Recording Member—

A thermoreversible recording member used in the present invention is superior in convenience because the thermoreversible recording layer capable of reversible display, and an information storage section are provided on the same card or tag (so as to form a single unit), and part of information stored in the information storage section is displayed on the recording layer, thereby making it is possible to confirm the information by simply looking at a card or a tag without needing a special device. Also, when information stored in the information storage section is rewritten, rewriting of information displayed in the thermoreversible recording member makes it possible to use the thermoreversible recording medium repeatedly as many times as desired.

The information storage section is suitably selected depending on the intended purpose without any restriction, and suitable examples thereof include a magnetic recording layer, a magnetic stripe, an IC memory, an optical memory and an RF-ID tag. In the case where the information storage section is used for process control, product control, etc., an RF-ID tag is particularly preferable.

The RF-ID tag is composed of an IC chip, and an antenna connected to the IC chip.

The thermoreversible recording member includes the recording layer capable of reversible display, and the information storage section. Suitable examples of the information storage section include an RF-ID tag.

Figure 11:
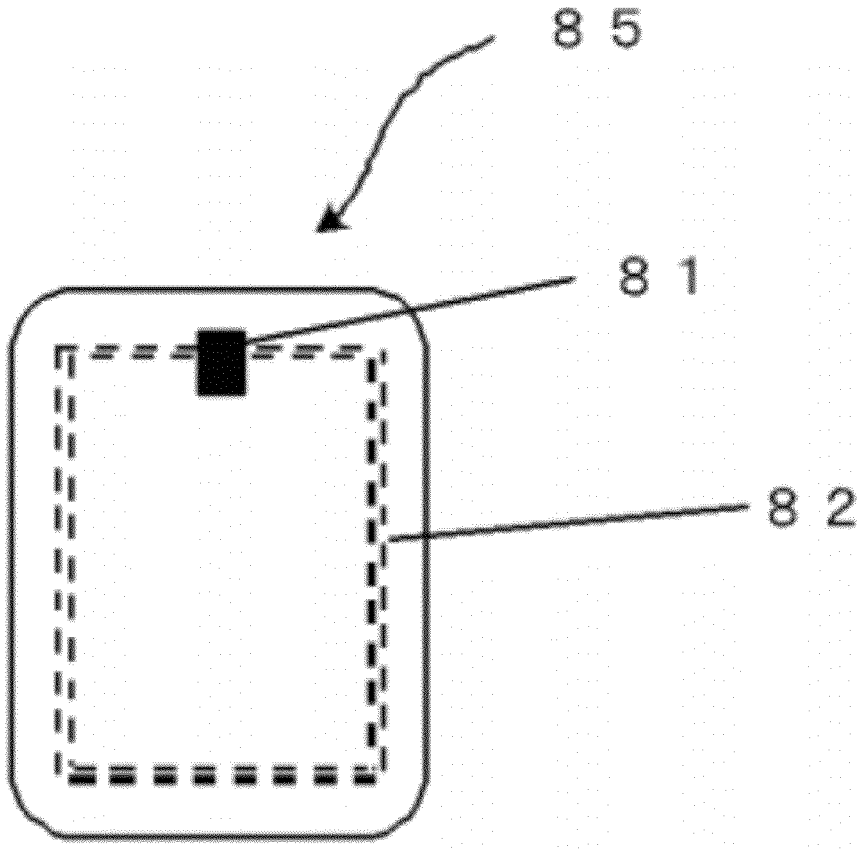
FIG. 11 is a schematic view showing an example of a RF-ID tag.

Here, FIG. 11 shows a schematic view showing an example of an RF-ID tag 85. This RF-ID tag 85 is composed of an IC chip 81, and an antenna 82 connected to the IC chip 81. The IC chip 81 is divided into four sections, i.e. a storage section, a power adjusting section, a transmitting section and a receiving section, and communication is conducted as they perform their operations allotted. As for the communication, the RF-ID tag 85 communicates with an antenna of a reader/writer by means of a radio wave so as to transfer data. Specifically, there are such two methods as follows: an electromagnetic induction method in which the antenna of the RF-ID tag 85 receives a radio wave from the reader/writer, and electromotive force is generated by electromagnetic induction caused by resonance; and a radio wave method in which electromotive force is generated by a radiated electromagnetic field. In both methods, the IC chip inside the RF-ID tag 85 is activated by an electromagnetic field from outside, information inside the chip is converted to a signal, then the signal is emitted from the RF-ID tag 85. This information is received by the antenna on the reader/writer side and recognized by a data processing unit, then data processing is carried out on the software side.

The RF-ID tag is formed into a label shape or a card shape and can be affixed to the thermoreversible recording medium. The RF-ID tag may be affixed to the recording layer surface or the back layer surface, preferably to the back surface layer.

To stick the RF-ID tag and the thermoreversible recording medium together, a known adhesive or tackiness agent may be used.

Additionally, the thermoreversible recording medium and the RF-ID tag may be integrally formed by lamination or the like and then formed into a card shape or a tag shape.

An example of usage of the thermoreversible recording medium in combination with the RF-ID tag in the process management will be described.

A process line on which containers containing delivered raw materials are conveyed is equipped with a unit by which a visible image is written on the display portion of a container being conveyed in a non-contact manner, and a unit by which a visible image is erased in a non-contact manner. In addition, the process line is equipped with a reader/writer for performing non-contact reading and overwriting of information by reading the information in the attached RF-ID of the container by transmission of electromagnetic waves. Furthermore, the process line is also equipped with a control unit for automatically performing sorting, weighing and management of containers on the distribution line on the basis of the individual information of the containers being conveyed, which the information is written or read out on or from the container without involving contact with the reader/writer.

Product inspection is performed by recording such information as product name and quantity in the RF-ID tag-equipped thermoreversible recording medium attached to the container. In the next step, instruction is given to process the delivered raw material, information for processing is recorded on the thermoreversible recording medium and the RF-ID tag, thereby creating a processing instruction and the materials proceed to the processing step according to the instruction. Next, order information is recorded on the thermoreversible recording medium and RF-ID tag as an order instruction for the processed product, shipping information is read from collected containers after product shipment and containers and the thermoreversible recording medium with the RF-ID tag are used again for delivery.

At this time, erasing/printing of information can be performed without peeling the thermoreversible recording medium off from the containers, etc. because of the non-contact recording on the thermoreversible recording media using laser. Furthermore, process can be managed in real time and information stored in the RF-ID tag can be displayed on the thermoreversible recording medium simultaneously, because the RF-ID can also store information without involving contact.

<Image Recording and Image Erasing Mechanism>

The image recording and image erasing mechanism includes an aspect in which color tone reversibly changes by heat. The aspect is such that a combination of a leuco dye and a reversible developer (hereinafter also referred to as "developer") enables the color tone to reversibly change by heat between a transparent state and a colored state.

Figure 5A:
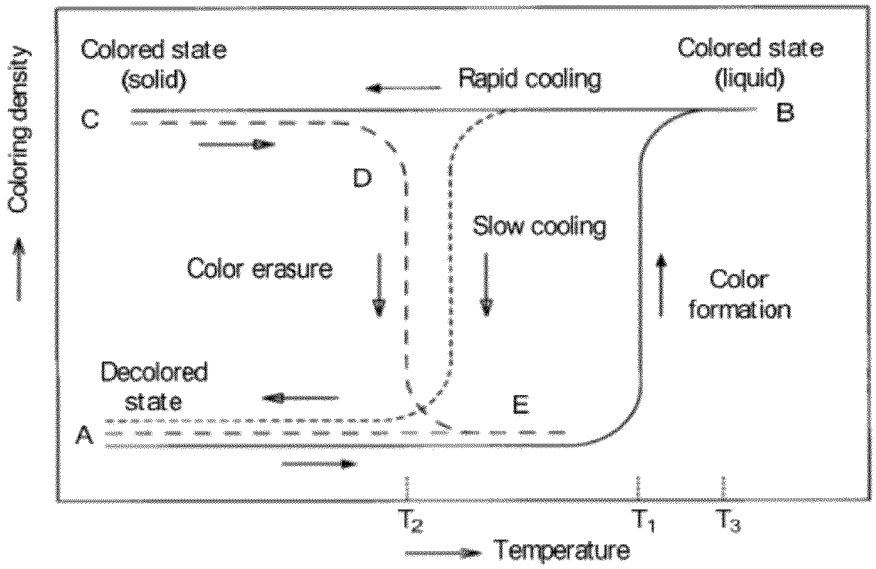
FIG. 5A is a graph showing the coloring and decoloring properties of a thermoreversible recording medium.
Figure 5B:
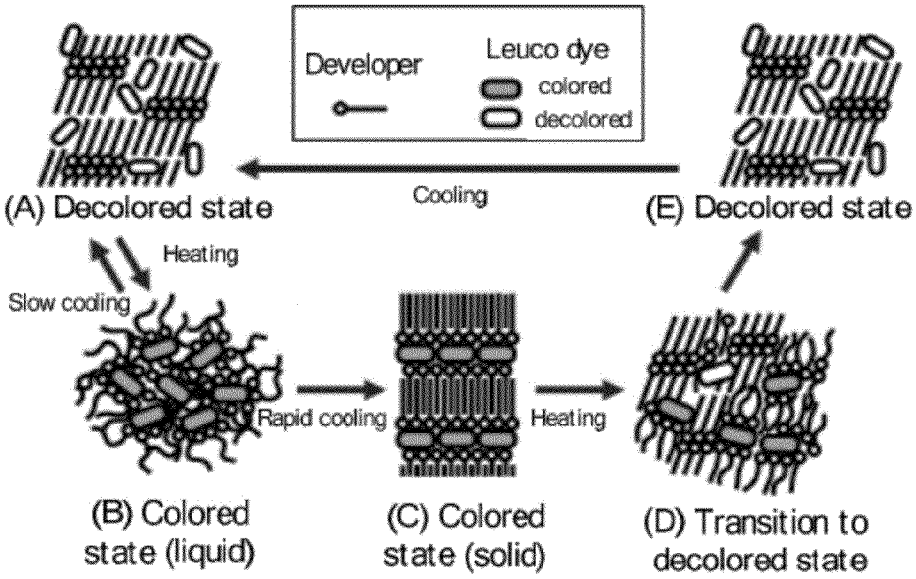
FIG. 5B is a schematic explanatory diagram showing a coloring and decoloring mechanism of a thermoreversible recording medium.

FIG. 5A shows an example of the temperature—coloring density change curve of a thermoreversible recording medium which has a thermoreversible recording layer formed of the resin containing the leuco dye and the developer. FIG. 5B shows the coloring and decoloring mechanism of the thermoreversible recording medium which reversibly changes by heat between a transparent state and a colored state.

First of all, when the recording layer in a decolored (colorless) state (A) is raised in temperature, the leuco dye and the developer melt and mix at the melting temperature $T_1$, thereby developing color, and the recording layer thusly comes into a melted and colored state (B). When the recording layer in the melted and colored state (B) is rapidly cooled, the recording layer can be lowered in temperature to room temperature, with its colored state kept, and it thusly comes into a colored state (C) where its colored state is stabilized and fixed. Whether or not this colored state is obtained depends upon the temperature decreasing rate from the temperature in the melted state: in the case of slow cooling, the color is erased in the temperature decreasing process, and the recording layer returns to the decolored state (A) it was in at the beginning, or comes into a state where the density is low in comparison with the density in the colored state (C) produced by rapid cooling. When the recording layer in the colored state (C) is raised in temperature again, the color is erased at the temperature $T_2$ lower than the coloring temperature (from D to E), and when the recording layer in this state is lowered in temperature, it returns to the decolored state (A) it was in at the beginning.

The colored state (C) obtained by rapidly cooling the recording layer in the melted state is a state where the leuco dye and the developer are mixed together such that their molecules can undergo contact reaction, which is often a solid state. This state is a state where a melted mixture (coloring mixture) of the leuco dye and the developer crystallizes, and thus color is maintained, and it is inferred that the color is stabilized by the formation of this structure. Meanwhile, the decolored state (A) is a state where the leuco dye and the developer are phase-separated. It is inferred that this state is a state where molecules of at least one of the compounds gather to constitute a domain or crystallize, and thus a stabilized state where the leuco dye and the developer are separated from each other by the occurrence of the flocculation or the crystallization. In many cases, phase separation of the leuco dye and the developer is brought about, and the developer crystallizes in this manner, thereby enabling color erasure with greater completeness.

As to both the color erasure by slow cooling from the melted state and the color erasure by temperature increase from the colored state shown in FIG. 5A, the aggregation structure changes at $T_2$, causing phase separation and crystallization of the developer.

Further, in FIG. 5A, when the temperature of the recording layer is repeatedly raised to the temperature $T_3$ higher than or equal to the melting temperature $T_1$, there may be caused such an erasure failure that an image cannot be erased even if the recording layer is heated to an erasing temperature. It is inferred that this is because the developer thermally decomposes and thus hardly flocculates or crystallizes, which makes it difficult for the developer to separate from the leuco dye. Degradation of the thermoreversible recording medium caused by repetitive image processing can be reduced by decreasing the difference between the melting temperature $T_1$ and the temperature $T_3$ in FIG. 5A when the thermoreversible recording medium is heated.

Here, the image erasing apparatus of the present invention will be generally described with reference to drawings.

Figure 6:
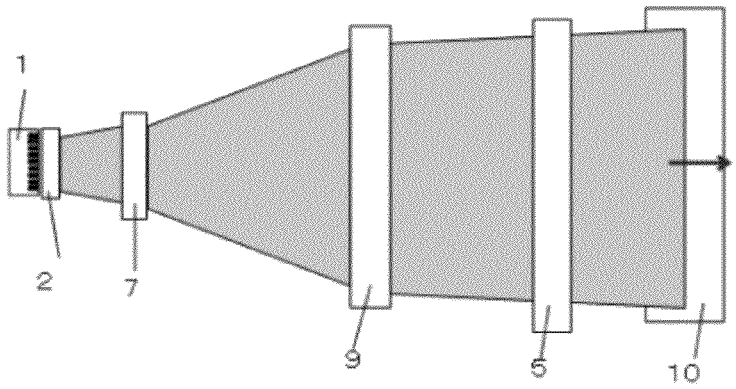
FIG. 6 is a schematic view showing an example of an image erasing apparatus of the present invention.

The image erasing apparatus of FIG. 6 includes a semiconductor laser (LD) array 1, a width direction collimating unit 2, a length direction light distribution controlling unit 7, a beam size adjusting unit 9, and a scanning unit 5.

As the semiconductor laser (LD) array 1, a LD array in which a plurality of LD light sources are aligned is used.

As the width direction collimating unit 2, an optical lens which collimates broadening of laser beams emitted from the semiconductor laser array in a width direction is used.

The length direction light distribution controlling unit 7 is configured to control the length of the major axis of the linear beam to be longer than the length of the major axis of the emission part of the semiconductor laser array, and to attain uniform light distribution in the length direction of the linear beam.

As the beam size adjusting unit 9, an optical lens which can adjust at least any one of the length of the major axis of the linear beam and the length of the minor axis thereof is used.

As the scanning unit 5, a uniaxial galvano mirror, a stepper motor mirror, a polygon mirror, and the like can be used. (1) The laser light scanning by a uniaxial galvano mirror can realize fine control in scanning, but the cost is high, (2) the laser light scanning by a stepper motor mirror can realize fine control in scanning, and the stepper motor mirror is less expensive than the uniaxial galvano mirror, and (3) the laser light scanning by a polygon mirror can be performed only at a constant speed, but the cost is low.

Alternatively, the thermoreversible recording medium may be moved in the following manner without providing the scanning unit: (1) the thermoreversible recording medium is moved using a stage; and (2) the thermoreversible recording medium is moved using a conveyor, specifically, the thermoreversible recording medium is adhered to a container, and the container is conveyed on the conveyor.

Figure 7:
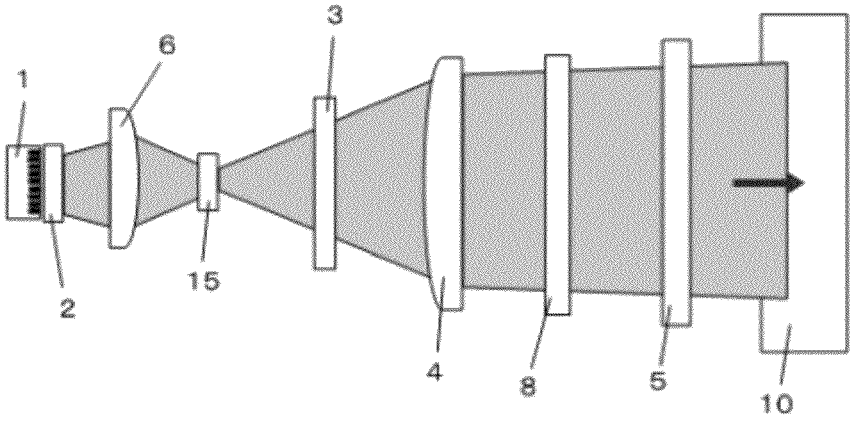
FIG. 7 is a schematic view showing another example of an image erasing apparatus of the present invention.

FIG. 7 is a schematic view of showing a specific embodiment of the image erasing apparatus of the present invention.

The image erasing apparatus of FIG. 7 uses a LD array in which nineteen LD light sources are aligned, and the length of the major axis of the emission part of the semiconductor laser array consisting of the first to nineteenth light sources is 10 mm.

Laser light emitted from a semiconductor laser array 1 is collimated in a width direction with a cylindrical lens 2 serving as the width direction collimating unit, and the collimated light is uniformly expanded in the width direction and in the length direction through two spherical lenses 4, 6 and the width of the light is adjusted through cylindrical lenses 3, 8.

A lens 15 has a function of uniformly expanding the width of the laser light by diffusing the laser light passed through the spherical lens 6 in order to attain uniform light distribution in the length direction. As the lens 15, Fresnel lens, a convex or concave lens array, or the like is used. In the present embodiment, the convex lens array and Fresnel lens are used.

The light distribution of the linear beam emitted from the width direction collimating unit 2 is not uniform, since it is a combination of beams emitted from a plurality of light sources. Thus, it is necessary to use an optical system for achieving uniform light distribution, and set-up of the above-described optical system is required.

Specifically, a planoconvex lens (focal distance: 70 mm) is used as the spherical lens 6, a plano-convex lens (focal distance 200 mm) is used as the spherical lens 4, and a planoconvex lens (focal distance: 200 mm) is used as the cylindrical lens 8. As the cylindrical lens 3, a plano-concave lens having a focal distance depending on a beam width is used, so that the beam width of each Example is achieved. Here, the focal distance of the cylindrical lens 3 is −1,000 mm, −400 mm, or −200 mm. The convex lenses each having different sizes are aligned at 400 μm-intervals to form an array.

Figure 8A:
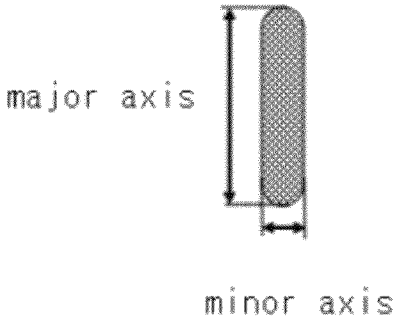
FIG. 8A is a view showing a shape of a linear laser beam
Figure 8B:
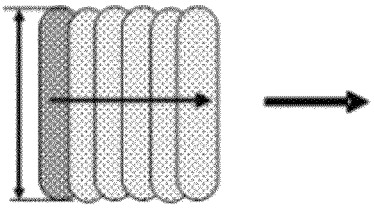
FIG. 8B is a view showing a laser beam scanning method of the present invention.

According to the image erasing apparatus shown in FIGS. 6 and 7, as shown in FIGS. 8A and 8B, the obtained linear beam has a uniform light distribution in a length direction, and the length of the major axis of the linear beam corresponds to a side of an area to be erased. The length to be scanned with the linear beam (distance) corresponds to another side of the area to be erased. Therefore, the laser beam scanning is performed in a uniaxial direction.

According to the image erasing apparatus and image erasing method, the following (1) to (5) effects can be achieved.

(1) In the case where erasure is performed using the linear beam, laser beam scanning is performed only in a uniaxial direction, and the number of scanning mirrors can be decreased, and the scanning with the laser beam can be easily controlled, thereby achieving low cost.

(2) Erasure using the linear beam can be performed at lower energy than that using the circular beam. This is because the linear beam can reduce energy loss due to thermal diffusion.

(3) By using the linear beam, no jumping (laser beam scanning without light) is required during the laser beam scanning. Thus, the undesirably extended erasing time due to jumping can be saved.

(4) The light source of the LD array can easily obtain high output at low cost, compared to that of a fiber coupled LD.

(5) As a result of repetitive erasure, the background color density generally increases. When the background color density is more than that of the initial background by 0.02, the maximum number of the repeated erasure using the circular beam is 400, and the maximum number of the repeated erasure using the linear beam is 5,000. The linear beam is superior to the circular beam. This is because it is not necessary to superimpose the laser beams.

The image erasing method and image erasing device of the present invention are capable of repetitively performing image erasing to a thermoreversible recording medium such as a label attached to a container such as a cardboard box or a plastic container in a non-contact system. For this reason, the image erasing method and image erasing device of the present invention are especially suitably used for distribution and delivery systems. In this case, an image can be recorded on and erased from the label while conveying the cardboard box or plastic container placed on the conveyor belt, and thus the time required for shipping can be reduced as it is not necessary to stop the production line.

Moreover, the label attached to the cardboard box or plastic container can be reused in the same state, and image erasing and recording can be performed again without removing the label from the cardboard box or plastic container.

EXAMPLES

Hereinafter, Examples of the present invention will be explained. However, it should be noted that the present invention is not confined to these Examples in any way.

Production Example 1

Production of Thermoreversible Recording Medium

A thermoreversible recording medium in which color tone reversibly changes by heat was produced in the following manner.

—Support—

As a support, a white turbid polyester film (TETORON FILM U2L98W, manufactured by Teijin DuPont Films Japan Limited) having a thickness of 125 μm was used.

—Formation of First Oxygen Barrier Layer—

An urethane adhesive (TM-567, manufactured by Toyo-Morton, Ltd.) (5 parts by mass), 0.5 parts by mass of isocyanate (CAT-RT-37, manufactured by Toyo-Morton, Ltd.) and 5 parts by mass of ethyl acetate were mixed and sufficiently stirred, so as to prepare an oxygen barrier layer coating solution.

Next, onto a silica-deposited PET film (TECHBARRIER HX, manufactured by Mitsubishi Plastics, Inc., an oxygen permeability: 0.5 ml/m$^2$/day/MPa), the oxygen barrier layer coating solution was applied using a wire bar, and then heated and dried at 80° C. for 1 min so as to form an oxygen barrier layer. The silica-deposited PET film on which the oxygen barrier layer had been formed was attached to the support, and then heated at 50° C. for 24 hr, so as to form a first oxygen barrier layer having a thickness of 12 μm on the support.

—Formation of First Thermoreversible Recording Layer—

Using a ball mill, 5 parts by mass of a reversible developer represented by Structural Formula (1) below, 0.5 parts by mass each of the two types of color erasure accelerators represented by Structural Formulae (2) and (3) below, 10 parts by mass of a 50 mass % acrylpolyol solution (hydroxyl value=200 mgKOH/g), and 80 parts by mass of methyl ethyl ketone were pulverized and dispersed such that the average particle diameter became approximately 1 μm.

Structural Formula (1)

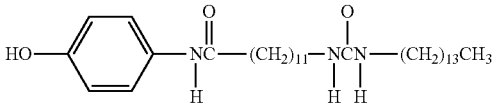

-continued

Structural Formula (2)

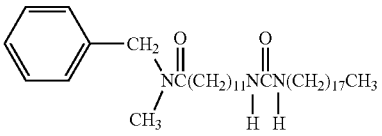

Structural Formula (3)

$C_{17}H_{35}CONHC_{18}H_{35}$

Next, into the dispersion solution in which the reversible developer had been pulverized and dispersed, 1 part by mass of 2-anilino-3-methyl-6-dibutylaminofluoran as a leuco dye, and 5 parts by mass of an isocyanate (CORONATE HL, manufactured by Nippon Polyurethane Industry Co., Ltd.) were added, and then sufficiently stirred to thereby prepare a thermoreversible recording layer coating solution.

The prepared thermoreversible recording layer coating solution was applied, to the first oxygen barrier layer using a wire bar, and then dried at 100° C. for 2 min, then cured at 60° C. for 24 hr so as to form a first thermoreversible recording layer having a thickness of 6.0 μm.

—Formation of Photothermal Conversion Layer—

A mixture of 4 parts by mass of 1% by mass of phthalocyanine photothermal conversion material solution (IR-915, manufactured by NIPPON SHOKUBAI Co., Ltd. absorption peak wavelength: 956 nm), 10 parts by mass of a 50% by mass acrylpolyol solution (hydroxyl value=200 mgKOH/g), 20 parts by mass of methyl ethyl ketone, and 5 parts by mass of an isocyanate (CORONATE HL, manufactured by Nippon Polyurethane Industry Co., Ltd.) was sufficiently stirred, so as to prepare a photothermal conversion layer coating solution. The obtained photothermal conversion layer coating solution was applied onto the first thermoreversible recording layer using a wire bar, and dried at 90° C. for 1 min, and then cured at 60° C. for 24 hr so as to form a photothermal conversion layer having a thickness of 3 μm.

—Formation of Second Thermoreversible Recording Layer—

The same composition for the thermoreversible recording layer as that of the first thermoreversible recording layer was applied onto the photothermal conversion layer using a wire bar, and dried at 100° C. for 2 min, and then cured at 60° C. for 24 hr so as to form a second thermoreversible recording layer having a thickness of 6.0 μm.

—Formation of Ultraviolet Absorbing Layer—

A 40% by mass ultraviolet absorbing polymer solution (UV-G300, manufactured by NIPPON SHOKUBAI CO., LTD.) (10 parts by mass), 1.5 parts by mass of isocyanate (CORONATE HL, manufactured by Nippon Polyurethane Industry Co., Ltd.) and 12 parts by mass of methyl ethyl ketone were mixed and sufficiently stirred so as to prepare an ultraviolet absorbing layer coating solution.

Next, the prepared ultraviolet absorbing layer coating solution was applied onto the second thermoreversible recording layer using a wire bar, and heated and dried at 90° C. for 1 min, and further heated at 60° C. for 24 hr so as to form an ultraviolet absorbing layer having a thickness of 1 μm.

—Formation of Second Oxygen Barrier Layer—

The same silica-deposited PET film on which the oxygen barrier layer had been formed as that of the first oxygen barrier layer was attached to the ultraviolet absorbing layer, and then heated at 50° C. for 24 hr, so as to form a second oxygen barrier layer having a thickness of 12 μm.

—Formation of Back Layer—

Pentaerythritol hexaacrylate (KAYARAD DPHA, manufactured by Nippon Kayaku Co., Ltd.) (7.5 parts by mass), 2.5 parts by mass of an urethane acrylate oligomer (ART RESIN UN-3320HA, manufactured by Negami Chemical Industrial Co., Ltd.), 2.5 parts by mass of a needle-like conductive titanium oxide (FT-3000, major axis=5.15 μm, minor axis=0.27 μm, structure: titanium oxide coated with antimony-doped tin oxide; manufactured by Ishihara Sangyo Kaisha, Ltd.), 0.5 parts by mass of a photopolymerization initiator (IRGACURE 184, manufactured by Nihon Ciba-Geigy K.K.) and 13 parts by mass of isopropyl alcohol were mixed, and sufficiently stirred using a ball mill, so as to prepare a back layer coating solution.

Next, the back layer coating solution was applied, using a wire bar, to the surface of the support opposite to the surface thereof over which the first thermoreversible recording layer had already been formed, and heated and dried at 90° C. for 1 min, and then cross-linked by means of an ultraviolet lamp of 80 W/cm, so as to form a back layer having a thickness of 4 μm. Thus, a thermoreversible recording medium of Production Example 1 was produced.

Production Example 2

Production of Thermoreversible Recording Medium

A thermoreversible recording medium of Production Example 2 was produced in the same manner as in Production Example 1, except that lanthanum boride as the photothermal conversion material was applied to a thermoreversible recording layer coating solution, so as to have the same photothermal conversion ability as that of the photothermal conversion material of Production Example 1 to thereby produce a first thermoreversible recording layer having a thickness of 12 μm, and that a second thermoreversible recording layer, a photothermal conversion layer, and a second barrier layer were not formed.

Example 1, Example 2 and Comparative Example 1

Figure 9:
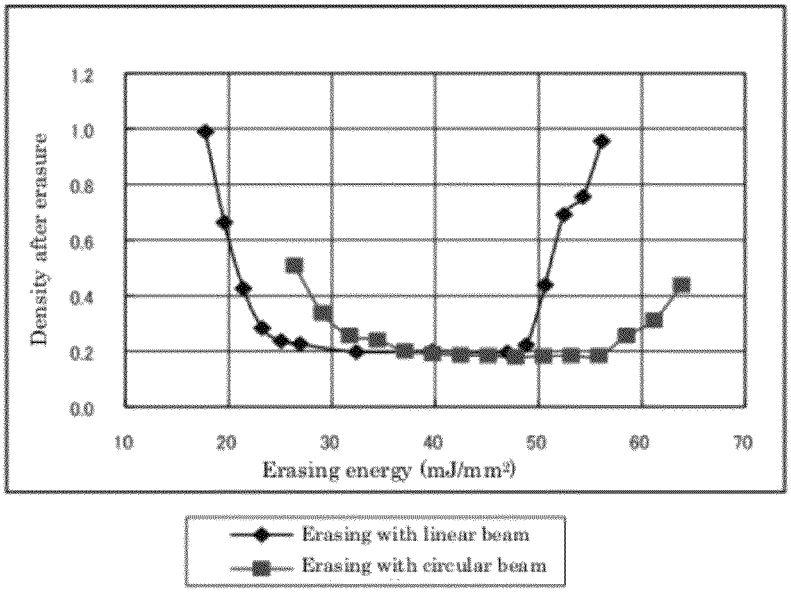
FIG. 9 is a graph showing a comparison of decoloring properties between different erasing methods.

In Examples 1 and 2, a solid image recorded on the thermoreversible recording medium prepared in Production Example 1 was erased using a linear beam of an image erasing apparatus (an erasing apparatus using a LD array light source) of the present invention shown in FIG. 7. In Example 1, a Fresnel lens was used as a lens 15, and in Example 2, a convex lens array was used as the lens 15. In Comparative Example 1, the same procedure to that of Example 1 was repeated expect that a circular beam of a conventional image erasing apparatus (a laser marker using a fiber coupled LD) shown in FIG. 1 was used instead of the linear beam. The erasing energy and erasing width were measured as follows. The results are shown in Table 1 and FIG. 9. FIG. 9 shows the results of Example 1 (erasure using the linear beam) and Comparative Example 1 (erasure using the circular beam).

In Comparative Example 1, the image was erased with the circular beam of the conventional image erasing apparatus. Specifically, laser light was emitted from Xt Corvus FB100-980-35-01 (center wavelength: 976 nm) manufactured by Spectra-Physics K.K., which was a fiber coupled LD (a semiconductor laser). The emitted laser light was passed through two collimator lenses (focal distance: 26 mm) to collimate the laser light, and the collimated laser light was swept by a galvano scanner 6230H (manufactured by Cambridge), and condensed with an fθ lens (focal distance: 141 mm). In the manner mentioned above, an area of 40 mm×40 mm was erased at a pitch width of 0.60 mm by the laser beam scanning method shown in FIG. 10 under the conditions that the distance between the light source and the medium was 180 mm (a circular beam having a diameter of 3.0 mm) and a linear scanning velocity was 1,000 mm/s.

In Examples 1 and 2, the image was erased using the linear beam of the image erasing apparatus of the present invention. Specifically, a LD bar light source equipped with a collimator lens JOLD-55-CPFN-1L-976 manufactured by JENOPTIK AG (center wavelength: 976 nm, output: 55 W) as a LD array light source and optical lenses shown in FIG. 7 were assembled and adjusted so that the linear beam illuminated an area having a length of 40 mm and a width of 0.35 mm on the thermoreversible recording medium, and the thermoreversible recording medium was scanned with the linear beam using a galvano scanner 6230H, manufactured by Cambridge, which was a galvano mirror. By the scanning method shown in FIG. 8B, an area of 40 mm×40 mm was erased at a linear scanning velocity of 20 mm/s.

<Measurement of Erasing Energy and Erasing Width>

Figure 10:
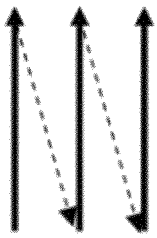
FIG. 10 is an explanatory view of laser beam scanning without irradiating with the laser beam.

Using the circular beam of the conventional image erasing apparatus of Comparative Example 1, recording was performed by the laser beam scanning method shown in FIG. 10, so that a solid image density became 1.40 at a pitch width of 0.60 mm under the conditions that the distance between the light source and the medium was 141 mm, a linear scanning velocity was 2,500 mm/s. Then, the solid image was erased by the above-described image erasing method with changing the irradiation power, to thereby obtain the erasing energy and the erasing width, in which the difference in color density between the erased portion and background became 0.020 or less.

The erasing energy was defined as an average value of the maximum value of an energy density which could erase the solid image and the minimum value thereof, in which the energy density which could erase the solid image was defined as the irradiation energy of the laser beam when the background color density after the solid image was erased became 0.02 or less of the background color density before the solid image was formed. The erasing width was defined as (maximum value−minimum value)/(maximum value+minimum value). The color density was measured using a reflection densitometer (938 Spectrodensitometer, manufactured by X-rite).

TABLE 1

| | | Erasing energy | Erasing width |
|---|---|---|---|
| Example 1 | Erasing with linear beam | 39.6 mJ/mm$^2$ | ±22% |
| Example 2 | Erasing with linear beam | 39.2 mJ/mm$^2$ | ±24% |
| Comparative Example 1 | Erasing with circular beam | 44.9 mJ/mm$^2$ | ±21% |

From the results of FIG. 9 and Table 1, the erasure using the linear beam of each of the image erasing apparatuses of the present invention of Examples 1 and 2 was performed at lower energy than the erasure using the circular beam of the conventional image erasing apparatus of Comparative Example 1. It was considered that use of the linear beam reduce energy loss due to thermal diffusion. The image erasing apparatus of Example 2 could secure wider erasing width than that of Example 1, and had superior in decoloring properties to that of Example 1. This was because the light distribution uniformity in the length direction of the linear beam was improved in Example 2.

<Evaluation of Erasing Time>

Next, using the circular beam of the conventional image erasing apparatus of Comparative Example 1 and the linear beam of the image erasing apparatus of the present invention of Examples 1 and 2, each of the duration of erasing the solid image of 40 mm×40 mm recorded on each of the thermoreversible recording medium of Production Example 1 at an irradiation power of 30 W was measured. The results are shown in Table 2.

TABLE 2

| | | Erasing time |
|---|---|---|
| Example 1 | Erasing using linear beam | 2.11 sec |
| Example 2 | Erasing using linear beam | 2.09 sec |
| Comparative Example 1 | Erasing using circular beam | 2.75 sec |

From the results of Table 2, it was understood that the duration of the erasure of each of Examples 1 and 2 was shorter than that of Comparative Example 1 under the same irradiation power. This was because it was not necessary to perform jumping (i.e. laser beam scanning without light) (see FIG. 10) in the case of using the linear beam of the image erasing apparatus of the present invention of each of Examples 1 and 2, and the erasing time was not extended, in addition to erasing the solid image at low energy.

The erasing energy and erasing time of the image erasing apparatus of the present invention decreased compared to those of the conventional erasing apparatus, respectively by approximately 10% and approximately 20%.

<Evaluation of Background Coloring (Background Fog) Due to Repetitive Erasure>

Next, using the circular beam of the conventional image erasing apparatus of Comparative Example 1 and using the linear beam of the image erasing apparatus of the present invention of Example 1, each of the influence of background coloring (background fog) due to repetitive erasure was evaluated as follows.

—Evaluation Method of Background Coloring (Background Fog) after Repetitive Erasure—

Erasure was repeatedly performed on a part of the background of the thermoreversible recording medium of Production Example 1, where no image was recorded, and the number of the repeated erasure immediately before the difference in color density between the erased portion and the background became more than 0.020 was determined. Here, the erasing energy was set at an average value of the maximum value of the energy density which could erase the solid image and the minimum value thereof. The color density was measured using a reflection densitometer (938 Spectrodensitometer, manufactured by X-rite).

As a result of repetitive erasure, the background color density increased, and when the background color density was more than that of the initial background by 0.02, the maximum number of the repeated erasure using the circular beam of the conventional image erasing apparatus of Comparative Example 1 was 400, and the maximum number of the repeated erasure using the linear beam of the image erasing apparatus of the present invention of Example 1 was 5,000. The linear beam of the image erasing apparatus of the present invention of Example 1 was superior in the prevention of background fog to the circular beam of the conventional image erasing apparatus of Comparative Example 1. This might be because it was not necessary to superimpose the laser beams on the thermoreversible recording medium in the case of the linear beam of the image erasing apparatus of the present invention of Example 1.

Next, in the image erasing apparatus of the present invention of Example 2, the focal distance of the cylindrical lens was changed so as to change the width of the linear beam (a length of the minor axis thereof), and the erasing energy and the erasing width were measured. The results are shown in Table 3.

TABLE 3

| | | Beam width | Erasing energy | Erasing width |
|---|---|---|---|---|
| Example 2 | Erasing using linear beam | 0.35 mm | 39.2 mJ/mm$^2$ | ±24% |
| | | 0.60 mm | 44.1 mJ/mm$^2$ | ±30% |
| | | 0.90 mm | 47.8 mJ/mm$^2$ | ±35% |

From the results of Table 3, it was found that the erasing energy and the erasing width were controlled by controlling the beam width of the linear beam of the image erasing apparatus of the present invention of Example 2, and that erasure could be performed by controlling the beam width (minor axis of the beam) depending on the medium and the area to be erased.

Example 3

In the image erasing apparatus of the present invention of Example 2 shown in FIG. 7 a stepper motor mirror was mounted instead of the galvano mirror, the scanning of the stepper motor mirror was adjusted so that the linear beam scanning was performed at a linear scanning velocity of 20 mm/s. When a solid image was recorded and erased in the same manner as in Example 2, and the solid image could be completely erased. The difference in color density between the erased portion and the background was 0.00.

Example 4

In the image erasing apparatus of the present invention of Example 2 shown in FIG. 7 a polygon mirror was mounted instead of the galvano mirror, the number of rotating the polygon mirror was adjusted so that the linear beam scanning was performed at a linear scanning velocity of 20 mm/s. When a solid image was recorded and erased in the same manner as in Example 2, and the solid image could be completely erased. The difference in color density between the erased portion and the background was 0.00.

Example 5

In the image erasing apparatus of the present invention of Example 2 shown in FIG. 7, the galvano mirror was removed from the apparatus, and a solid image was recorded on the thermoreversible recording medium of Production Example 1 in the same manner as in Example 2. The thermoreversible recording medium was attached onto a plastic container and the plastic container was placed on a conveyor, and the solid image was erased while the plastic container was moved by the conveyor at a traveling speed of 20 mm/s (1.2 m/min). The solid image was completely erased. The difference in color density between the erased portion and the background was 0.00.

Example 6

Using the image erasing apparatus of the present invention shown in FIG. 7, a solid image was recorded and erased on the thermoreversible recording medium of Production Example 2 in the same manner as in Example 2, and the solid image could be completely erased. The difference in color density between the erased portion and the background was 0.00.

The image erasing method and the image erasing apparatus of the present invention requires laser beam scanning only in a uniaxial direction, so that erasing can be performed at high speed with low energy and a cost for an apparatus significantly reduces. Therefore, the image erasing method and the image erasing apparatus of the present invention can be widely used in In-Out tickets, stickers for frozen meal containers, industrial products and various medical containers, and large screens and various displays for logistical management application use and production process management application use, and can be particularly suitably used in logistical/physical distribution systems, and process management systems in plants.

What is claimed is:

1. An image erasing apparatus comprising:

a semiconductor laser array in which a plurality of semiconductor laser light sources are linearly aligned;

a width direction collimating unit provided on an output surface of the semiconductor laser array, and configured to collimate, in a width direction, broadening of laser beams emitted from the semiconductor laser array so as to form a linear beam; and a length direction light distribution controlling unit configured to control a length of a major axis of the linear beam to be longer than a length of a major axis of an emission part of the semiconductor laser array, and to attain uniform light distribution in the length direction of the linear beam, wherein the linear beam, which has the major axis whose length is longer than the length of the major axis of the emission part of the semiconductor laser array and uniform light distribution in the length direction thereof, is to be applied to and heat a thermoreversible recording medium, in which any of transparency and color tone thereof reversibly changes depending on temperature, so as to erase an image recorded on the thermoreversible recording medium.

2. The image erasing apparatus according to claim 1, further comprising a beam size adjusting unit configured to adjust at least one of the length of the major axis of the linear beam and a length of a minor axis of the linear beam, wherein the linear beam has the major axis whose length is longer than the length of the major axis of the emission part of the semiconductor laser array and uniform light distribution in the length direction of the linear beam.

3. The image erasing apparatus according to claim 1, wherein the width direction collimating unit is a cylindrical lens.

4. The image erasing apparatus according to claim 1, wherein the length direction light distribution controlling unit is a lens array.

5. The image erasing apparatus according to claim 1, wherein the length direction light distribution controlling unit is a Fresnel lens.

6. The image erasing apparatus according to claim 1, further comprising a scanning unit configured to scan the thermoreversible recording medium in a uniaxial direction with the linear beam having the major axis whose length is longer than the length of the major axis of the emission part of the semiconductor laser array and uniform light distribution in the length direction of the linear beam.

7. The image erasing apparatus according to claim 6, wherein the scanning unit is a uniaxial galvano mirror.

8. The image erasing apparatus according to claim 6, wherein the scanning unit is a stepper motor mirror.

9. The image erasing apparatus according to claim 6, wherein the scanning unit is a polygon mirror.

10. The image erasing apparatus according to claim 1, further comprising a moving unit configured to move the thermoreversible recording medium with respect to the linear beam having the major axis whose length is longer than the length of the major axis of the emission part of the semiconductor laser array and uniform light distribution in the length direction of the linear beam so that the thermoreversible recording medium is scanned with the linear beam to erase an image recorded on the thermoreversible recording medium.

11. The image erasing apparatus according to claim 10, wherein the thermoreversible recording medium is attached onto a surface of a container, and the moving unit is configured to move the container.

12. An image erasing method comprising:

collimating in a width direction broadening of laser beams emitted from a semiconductor laser array, in which a plurality of semiconductor laser light sources are linearly aligned, so as to form a linear beam; and controlling the linear beam to have a major axis whose length is longer than a length of a major axis of an emission part of the semiconductor laser array, and uniform light distribution in a length direction of the linear beam, wherein the linear beam, which has the major axis whose length is longer than the length of the major axis of the emission part of the semiconductor laser array and uniform light distribution in the length direction thereof, is to be applied to and heat a thermoreversible recording medium, in which any of transparency and color tone thereof reversibly changes depending on temperature, so as to erase an image recorded on the thermoreversible recording medium.

13. The image erasing method according to claim 12, further comprising adjusting at least one of the length of the major axis of the linear beam and a length of a minor axis of the linear beam, wherein the linear beam has the major axis whose length is longer than the length of the major axis of the emission part of the semiconductor laser array and uniform light distribution in the length direction of the linear beam.

14. The image erasing method according to claim 12, further comprising scanning the thermoreversible recording medium in a uniaxial direction with the linear beam having the major axis whose length is longer than the length of the major axis of the emission part of the semiconductor laser array and uniform light distribution in the length direction of the linear beam.

15. The image erasing method according to claim 12, wherein the erasure of the image recorded on the thermoreversible recording medium is performed by moving the thermoreversible recording medium by means of a moving unit so as to scan the thermoreversible recording medium with the linear beam having the major axis whose length is longer than the length of the major axis of the emission part of the semiconductor laser array and uniform light distribution in the length direction of the linear beam.

* * * * *